US011204032B2

(12) United States Patent
Meyer et al.

(10) Patent No.: US 11,204,032 B2
(45) Date of Patent: Dec. 21, 2021

(54) HIGH PRESSURE PUMPING SYSTEM

(71) Applicant: Viking Pump, Inc., Cedar Falls, IA (US)

(72) Inventors: Scott Meyer, Brandon, IA (US); Justin Pierce, Dunkerton, IA (US); Ryan Weide, Hudson, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 202 days.

(21) Appl. No.: 16/516,701

(22) Filed: Jul. 19, 2019

(65) Prior Publication Data

US 2020/0025196 A1 Jan. 23, 2020

Related U.S. Application Data

(60) Provisional application No. 62/700,567, filed on Jul. 19, 2018.

(51) Int. Cl.

| | |
|---|---|
| ***F04C 2/18*** | (2006.01) |
| ***F04C 13/00*** | (2006.01) |
| ***F04C 15/00*** | (2006.01) |
| ***F04C 23/00*** | (2006.01) |

(52) U.S. Cl.

CPC ..... *F04C 2/18* (2013.01); *F04C 13/001* (2013.01); *F04C 15/0003* (2013.01); *F04C 23/001* (2013.01); *F04C 2240/30* (2013.01); *F05C 2201/0448* (2013.01)

(58) Field of Classification Search

CPC ..... F04C 2/18; F04C 11/001; F04C 13/001; F04C 15/0003; F04C 23/001; F04C 2240/30; F05C 2201/0448

See application file for complete search history.

(56) References Cited

U.S. PATENT DOCUMENTS

| | | | | |
|---|---|---|---|---|
| 6,692,244 | B2 * | 2/2004 | Bhagavatula | F04C 15/0046 418/102 |
| 2004/0213663 | A1 * | 10/2004 | Duerr | F16C 19/548 415/111 |
| 2005/0232784 | A1 * | 10/2005 | Yates | F04C 15/0073 417/199.1 |
| 2009/0208357 | A1 * | 8/2009 | Garrett | F04C 2/18 418/152 |

FOREIGN PATENT DOCUMENTS

DE 20 2006 012 409 * 11/2006

OTHER PUBLICATIONS

Machine Translation DE 20 2006 012 409 (Year: 2021).*

* cited by examiner

*Primary Examiner* — Audrey B. Walter
*Assistant Examiner* — Dapinder Singh
(74) *Attorney, Agent, or Firm* — Tucker Ellis LLP

(57) ABSTRACT

One or more techniques and/or systems are disclosed for a pump technology that provides for more effective and efficient transfer of liquids, such as petroleum products and components, to and through pipelines. Such a technology can comprise a type of external gear pump that creates higher flow, resulting in higher pressures in the pipeline, to move the liquids, while providing for longer pump life, simpler and less maintenance, and fewer undesired conditions, with a smaller footprint, in a cost-effective system.

17 Claims, 17 Drawing Sheets

HIGH PRESSURE PUMPING SYSTEM

This patent application claims priority from United States provisional patent application having application No. 62/700,567 filed on Jul. 19, 2018.

BACKGROUND

Crude oil and other petroleum products and components can be transported using a pipeline, for example, from an oilfield to storage facilities and refineries. A pump may be used to help move the liquids from the oilfields to the pipeline, and through the pipeline to the storage facilities and refineries. Various types of pumps can be used, the types, power and size may be dependent on the type of liquid, distance, characteristics, and/or pipeline size. Existing external gear pumps used for hydraulic applications cannot handle the lower viscosity and reduced lubricating properties of the crude oil, and some other petroleum products, or the typical sand and other particles found in oil wells. Other technologies such as progressing cavity pumps require multiple stages making the pump extremely long, with a large footprint.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

One or more techniques and systems are described herein for a pump technology that provides for more effective and efficient transfer of liquids, such as petroleum products and components, to and through pipelines. Such a technology can comprise a type of external gear pump that creates higher flow, resulting in higher pressures in the pipeline, to move the liquids, while providing for longer pump life, simpler and less maintenance, and fewer undesired conditions, with a smaller footprint, in a cost-effective system.

In one implementation, a pump for use in a high-pressure pipeline can comprise a pump bracket. In this implementation, the pump bracket can comprise a bearing housing that is disposed proximate a motor coupling end of the pump. The bearing housing is operably holding a bearing assembly that provides support to a pump driver shaft from axial and radial force applied to the driver shaft under load. The pump bracket can further comprise a seal chamber that is disposed distally from the bearing housing. The seal chamber can hold a selectably removable seal that is fixedly engaged with the driver shaft during operation to mitigate leakage of a pumped fluid from inside a pump housing to outside the pump housing. A drive shaft cavity can be disposed in the bracket, running through the bracket, and configured to operably hold the driver shaft.

In this implementation, the pump can comprise a first gear casing that is fixedly engaged with the bracket during operation. The first gear casing can comprise a first gear chamber that operably holds a driver gear and a driven gear, where the driver gear can be meshedly engaged with the driven gear engaged with a first driven shaft in the first gear chamber, and the driver gear can be operably, fixedly engaged with the driver shaft such that the driver gear rotates when the driver shaft is rotated resulting in fluid being drawn into the first gear chamber on a first side, and discharged from the first gear chamber on a second side.

The pump can also comprise a first port and a second port disposed in the pump housing. The first port can comprise a discharge port when the pump is disposed in a clockwise orientation and a suction port when the pump is disposed in a counter-clockwise orientation. Further, the second port can comprise a suction port when the pump is disposed in a clockwise orientation and a discharge port when the pump is disposed in a counter-clockwise orientation. Additionally, the pump can comprise a casing head that is disposed at the distal end of the pump. The casing head can be selectably, fixedly engaged with the gear casing and bracket; and the casing head can comprise a driver shaft end cavity to operably hold the driver shaft, the driver shaft end cavity closed at the distal end inside the casing head.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

DETAILED DESCRIPTION

Figure 1B:
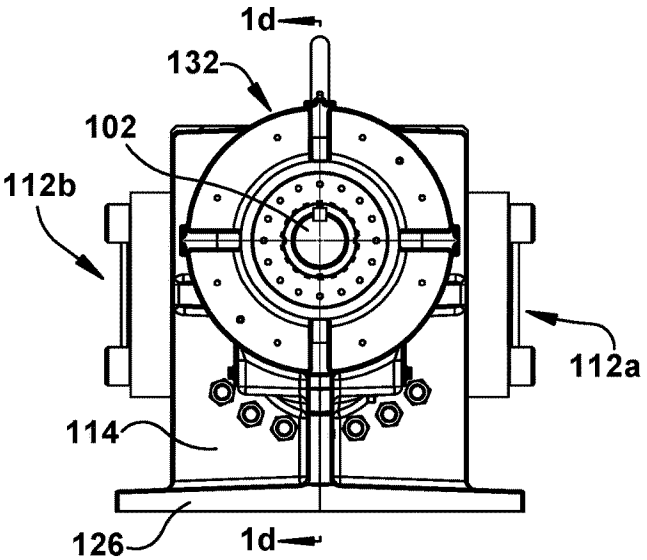
FIGS. 1*a*, 1*b*, 1*c*, and 1*d* are component diagrams illustrating various views of one implementation of an example external gear pump that may be used for pipeline injection.
Figure 1A:
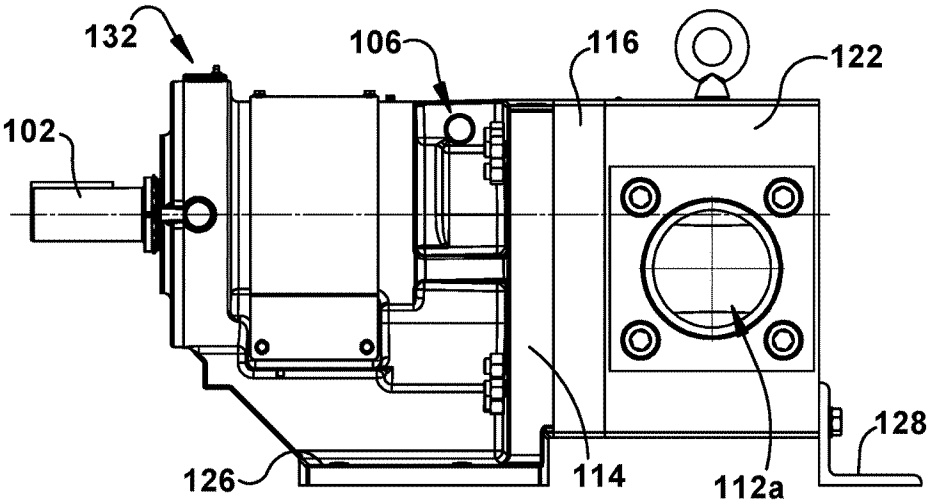
Figure 1C:
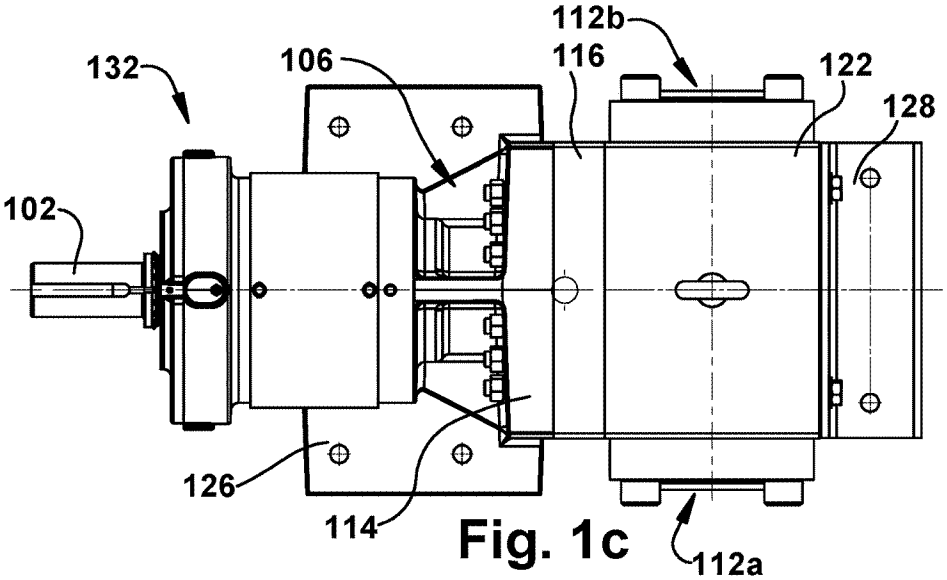

The claimed subject matter is now described with reference to the drawings, wherein like reference numerals are generally used to refer to like elements throughout; however, different implementations of similar elements may be identified with different reference numerals. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Crude oil and other petroleum products and components can be economically transported from the oilfield to the refineries by pipelines, for example, versus over-the-road or rail transport. A pipeline injection pump may be devised that can be used to move crude oil, collecting from multiple wells or truck terminals, for example, into a petroleum product pipeline, and through the pipeline. As one example, due to frictional losses that incur in pipelines over long distances, the pump should be capable of handling very high pressures for low viscosity and low lubricating liquids, such as crude oil. As another example, a booster pump can be devised that may be used in a Lease Automatic Custody Transfer (LACT) unit for pumping petroleum products, such as crude oil, into pipelines at high pressures.

In one aspect, an external gear pump can be devised for use in transport of petroleum products, such as crude oil, while allowing for a more compact solution at a more cost effective price than existing technology. In this aspect, improved material of construction and internal component clearances can allow for improved function for the application of the pump, while allowing for a more compact footprint. As an example, the improved designs can save space used for operation of the pump platform, and can allow for a smaller housing to be used to enclose the pumping units that are in environments, for example, with wet weather and/or freezing temperatures. In this aspect, the improved material of construction and internal component clearances can also provide for a pump operation that is more reliable and has improved operational life over existing technology than existing systems.

Further, in one aspect, a pump can be devised with an innovative bracket design, which may allow for a plurality of mechanical seal options using merely the single, innovative bracket. For example, use of this innovative bracket can allow end users to choose between a standard component seal, a balanced component seal, or a cartridge seal, with provisions for leak detection systems. Additionally, in this aspect, gear sections can be added to the pump to increase the flow rate while maintaining the original pressure rating for the pump. For example, the addition of one or more gear sections to a pump may be like having two, three or more pumps, but with merely one seal and one prime mover. In one implementation, in this aspect, innovative machining of pump separation plates and heads can also be provided to allow the orientation of some parts to be flipped, to achieve a clockwise (CW) or counter-clockwise (CCW) build using the same part. That is, for example, one or more internal parts can be flipped around to have the pump flow in the opposite direction, instead of changing the input and output piping connected to the pump.

A pipeline injection pump may be devised that provides for petroleum product to be injected into a transport pipeline at high pressure, for example, in order to overcome the high pressure present in the pipeline transport system. In one implementation, an external gear pump can comprise improved material of construction and internal clearances designed for the application, allowing for a more compact solution. Further, a bracket design allows for the use of cartridge mechanical seal options with provisions for leak detection systems, and can accept API 682 compliant seals. In one implementation, the bracket can also incorporate a bearing housing configured to facilitate maintenance of the alignment of the shaft, and to help carry axial or radials loads that may be applied to the shaft. Additionally, gear sections can be added to the modular pump design to increase the flow rate while maintaining the same pressure rating.

FIGS. 1-6 illustrate various views of various implementations of a pipeline injection pump system. These example pump systems 100, 200, 300, 600 illustrate one or more implementations of a pump system that utilizes an external gear pump design, having material of construction and internal clearances designed for the application allowing for a more compact solution. In one aspect, an innovative bracket design allows for a variety of cartridge mechanical seal options, with provisions for leak detection systems, which can accept API 682 compliant seals. In these examples, an innovative bracket design can also incorporate a bearing housing to help keep the shaft aligned and carry applied axial or radials loads. Further, in some implementations, as illustrated, additional gear sections can be added to the design to increase the flow rate while maintaining a same pressure rating. For example, this is essentially like having two, three or more pumps, but with only one seal and one prime mover.

As an example, the innovative pump systems 100, 200, 300, 600 illustrated can provide an alternative positive displacement pump technology to the currently applied reciprocating pumps. For example, reciprocating pumps are extremely large, and they create a high pulsating flow that requires dampeners to reduce damage to the pipeline. The innovative external gear design described herein can produce a much smoother operation, and that can mitigate the need for the dampeners. Further, other existing pump systems use packing to seal the plungers, which leads to leakage of the pumped product (e.g., oil) onto the ground creating environmental concerns. The innovative pump system described herein mitigates the need to use this type of packing. Additionally, centrifugal pumps that are utilized for similar systems are very long due to the need for multiple stages to attain the high-pressure rating. Because centrifugal pumps create pressure rather than flow, like positive displacement pump, they operate on a different type of curve where the flow rate is greatly dependent on the pressure needed to inject the crude oil into the pipeline. These centrifugal pumps require complex controls systems or valves to keep the pump operating at a specific flow on its curve.

FIGS. 1*a*, 1*b*, 1*c*, and 1*d* are component diagrams, respectively illustrating a side view, a front view, a top view, and a side sectional view of an example pipeline injection pump 100, described herein. In this implementation, the example pump 100 may be used to inject petroleum product into a pipeline at elevated pressures, and provide for boosting or moving the product through the pipeline, such as from a storage facility to a remote refinery or storage facility.

In this implementation, as illustrated in FIGS. 1*a*-1*d*, the example pump 100 comprises a single gear pair configuration. The example pump 100 comprises a driver shaft 102 (e.g., a.k.a. drive shaft), which may be coupled with a motor during operation (operably coupled), to provide rotational power to the driver shaft 102. Further, fixedly engaged with the driver shaft 102 is a driver gear 108. Rotation of the driver shaft 102, such as by an operably coupled motor, results in rotation of the driver gear 108. The example pump 100 also comprise a driven gear 110, which, during operation (operably), is meshedly engaged with the driver gear 108. That is, for example, as the driver gear 108 rotates, due to rotation of the driver shaft 102, the meshed engagement with the driven gear 110 results in rotation (e.g., in an opposite direction) of the driven gear 110.

Figure 1D:
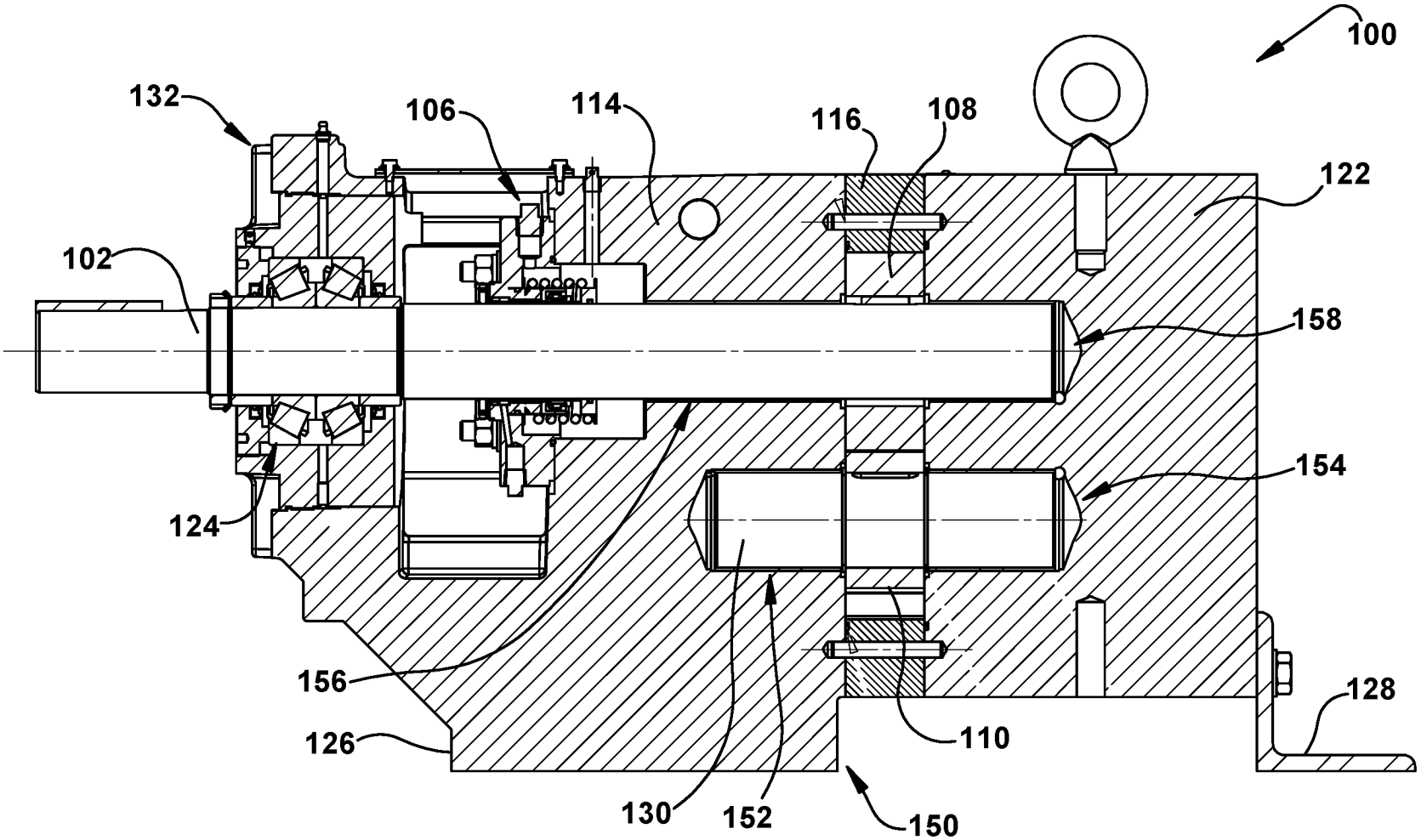
Figure 2B:
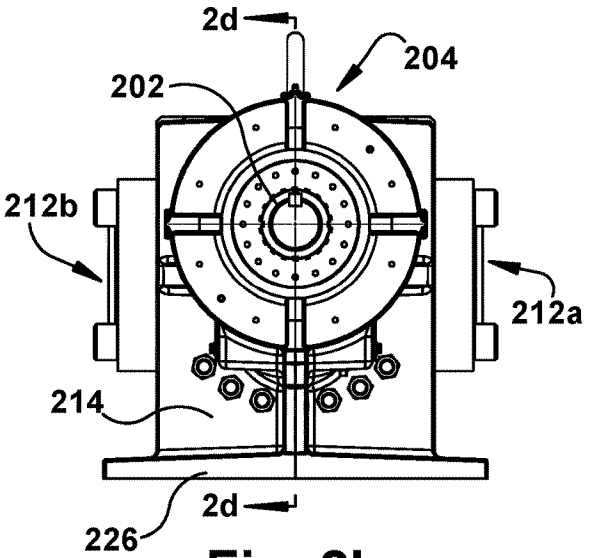
FIGS. 2*a*, 2*b*, 2*c*, and 2*d* are component diagrams illustrating various views of another implementation of an example external gear pump that may be used for pipeline injection.
Figure 2A:
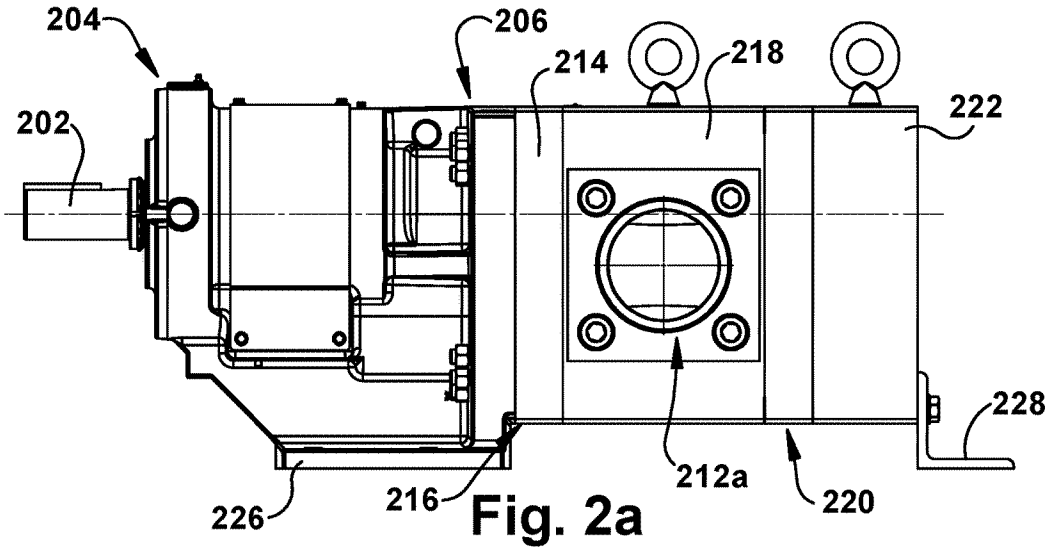
Figure 2C:
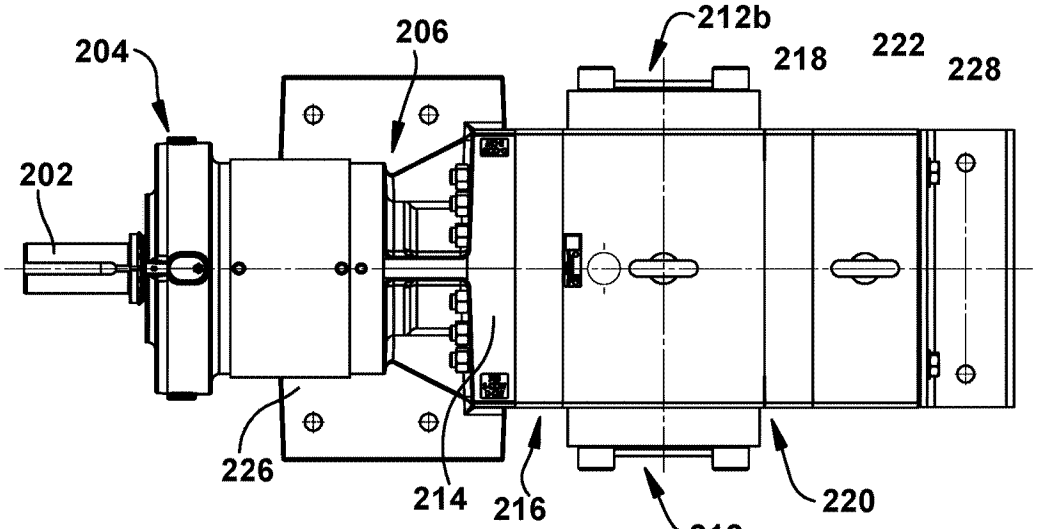
Figure 2D:
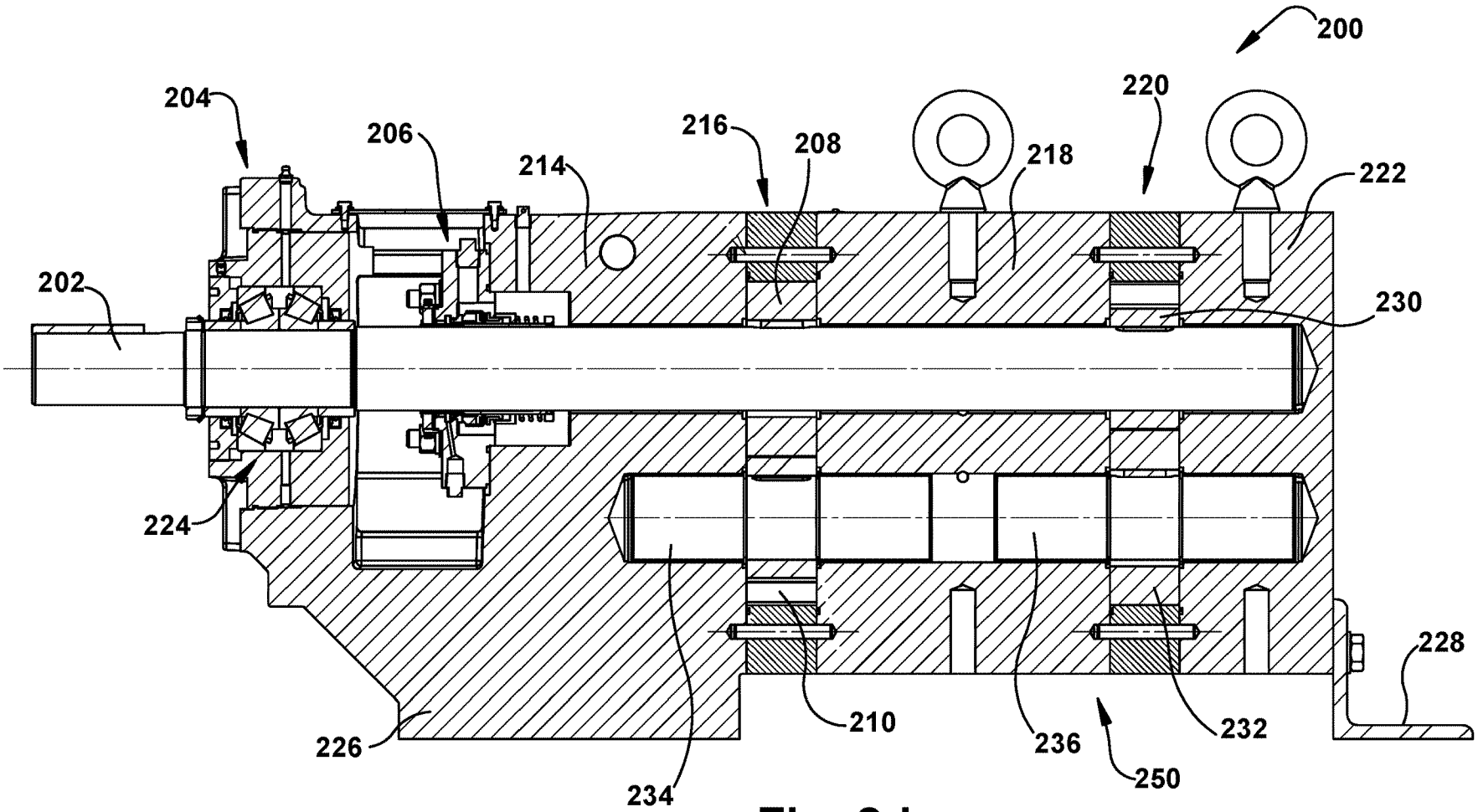

Additionally, the driven gear 110 is fixedly engaged with a driven shaft 130, which rotates substantially freely inside the housing 150 of the pump 100. The example pump 100 comprises a bracket 114, a gear casing 116, and a casing head 122. In this implementation, the bracket 114, gear casing 116, and the casing head 112 form the housing 150 of the pump 100. As illustrated in FIG. 1*d*, the bracket 114 and casing head 122 portions of the housing 150 respectively comprise a driven shaft cavity 152, 154. The respective driven shaft cavities 152, 154 are configured to receive the appropriate portions of the driven shaft 130, to allow the driven shaft 130 to rotate substantially freely around its axis, and to provide support to the driven shaft 130 such as when axial and/or radial loads are applied to the driven gear 110. In one implementation, the clearance between a wall of the respective driven shaft cavities 152, 154 and the complementary surface of the driven shaft 130 can be such that deviation from the axis of rotation of the driven shaft 130 is mitigated when axial and/or radial loads are applied. In this implementation, for example, the tolerance of the respective complementary surfaces of the shaft 130 and cavities 152, 154 is very low to accommodate the improved support of the shaft during application of loads to the driven gear 110.

As illustrated in FIG. 1*d*, the bracket 114 and casing head 122 portions of the housing 150 respectively comprise a driver shaft cavity 156, 158. The respective driver shaft cavities 156, 158 are configured to receive the appropriate portions of the driver shaft 102, to allow the driver shaft 102 to rotate substantially freely around its axis, and to provide support to the driver shaft 102 such as when axial and/or radial loads are applied to the driver gear 108. In one implementation, the clearance between a wall of the respective driver shaft cavities 156, 158 and the complementary surface of the driver shaft 102 can be such that deviation from the axis of rotation of the driver shaft 102 is mitigated when axial and/or radial loads are applied. In this implementation, for example, the tolerance of the respective complementary surfaces of the shaft 102 and cavities 156, 158 is small to accommodate the improved support of the shaft during application of loads to the driver gear 108.

In one implementation, the example pump 100 can comprise a seal 106 that provides a leak barrier between the inside and outside of the pump 100, at the location where the rotating shaft 102 enters the pump 100, to mitigate leakage of a pumped fluid out of the pump 100. In one implementation, the seal 106 can comprise a back pull out seal, which can be configured to allow removal of the seal 106 (e.g., and other pump components, such as a coupling, bearing, etc.) without disturbing the pump housing or pipework coupled with the pump 100. That is, for example, when maintenance is performed on the pump, such as replacing a seal or other component, the seal may be pulled out without removing or uncoupling the piping from the pump housing. For example, this can provide for less costly, faster, and easier maintenance, and mitigate potential down time and damage to other parts of the pipeline injection system. As an example, an advantage of this design is that the rotating assembly, including any bearings and shaft seals, may be readily pulled out of the pump casing. In this example, this design allows internal components to be inspected and replaced without having to remove the casing from the piping or platform.

As illustrated in FIGS. 1*a-d*, the example pump 100 can comprise a bearing housing 104 comprising a bearing assembly 124. In one implementation, the bracket 114 can comprise the bearing housing 104, which can be used to help keep the shaft 102 aligned and carry axial or radials loads that may be applied to the shaft. In one implementation, the bearing assembly 124 can comprise tapered roller thrust bearings. For example, tapered roller thrust bearings can be used to accommodate heavy axial and/or radial loads, and peak loads. In this way, for example, they may mitigate deviation of the shaft from its axis of rotation under heavy loads during operation. Further, as described above, the innovative bracket 114 can be configured to allow the bearing assembly 124 to be removed, inspected, and/or replaced without disturbing the remaining portions of the pump housing 150, including the attached piping. That is, for example, the bracket 114 can be removed to access the bearing assembly 124, the seal 106, and other portions of the pump 100 without removing the gear casing 116, and/or the casing head 122.

In this implementation, the casing head 122 of the pump comprises a first port 112*a* and a second port 112*b*. In one implementation, the first port 112*a* can comprise a pump outlet or discharge port, and the second port 112*b* can comprise a pump inlet or suction port. In this implementation, the pump can be configured in a clockwise (CW) configuration. In another implementation, the first port 112*a* can comprise a pump inlet or suction port, and the second port 112*b* can comprise a pump outlet or discharge port. In this implementation, the pump can be configured in a counter-clockwise (CCW) configuration. As an example, in these implementations, the casing head 122 can be configured to operate in a CW or CCW configuration, merely by flipping or rotating the orientation of the casing head 122 around its central axis, which is parallel to the axis of rotation of the shaft 102.

That is, for example, the casing head 122 can be rotated one-hundred and eighty degrees around the central axis so that the ports 112 are disposed in an opposite configuration as prior to the rotation. Further, the casing head 122 can be marked (e.g., stamped, labeled, etc.) at the respective ports denoting the discharge side and suction side, and marked with CW and CCW depending on the orientation of the casing head 122. As one example, the casing head 122 may be marked at the discharge port (e.g., 112*a*) with a CW when disposed in that orientation and an upside down CCW may also be marked on the casing head 122 proximate the discharge port (e.g., 112*a*). In this example, when the casing head 122 is rotated one-hundred and eighty degrees around its central axis, the discharge port may be disposed on the opposite side (e.g., 112*b*). In this orientation, the CCW will now appear upright, and the CW will appear upside down. This may serve as an indicator to the pump operator as to the operation of the pump, as rotating in a clockwise or counterclockwise orientation. In this implementation, the casing head 122 is modular, and does not need to be swapped out with a different casing head. Further, the innovative design of the gear casing 116 and bracket 114 as coupled with the casing head allow the respective parts to be modular, allowing for rotation of some parts, and addition of more gear sections, as described below.

As illustrated, the example, pump 100 comprises a first driver gear 108 and a first driven gear 110. The first driver gear 108 is fixedly engaged with the driver shaft 102 during operation (operably), and the first driver gear 108 rotates as the driver shaft 102 rotates. Further, the first driven gear 110 is fixedly engaged with the first driver shaft 130, and the rotation of the first driver gear 108 results in rotation of the first driven gear 110, due to the meshed engagement of the respective gears. In an external gear pump, the meshed engagement and rotation of the first driver gear 108 and first driven gear 100 result pumping of a fluid between the inlet port (e.g., 112*b*) and the outlet port (e.g., 112*a*). For example, the respective gears 108, 110 rotate inside pumping chambers (not shown) inside the gear casing 116, which are fluidly coupled with the respective ports 112. Additionally, the gears 108, 110 can be engaged with the respective shafts 102, 130 by various methods. For example, the gear may be press-fit on the shaft; alternately, the gear may be floated on the drive shaft with retaining rings. As an example, floating the gear on the shaft may help mitigate the gear from locking onto the drive shaft, for easier removal.

In one implementation, the driver shaft 102 can be locked to the bearing housing 104, instead of the gears, for example, in order to accept axial thrust with a thrust bearing. For example, this can allow a user to access the seal 106 while the pump remains in place, such as at an installation. In this example, the seal 106 can be pulled out through the same access hole, allowing the pump 100 to remain in place without further disassembly. In one implementation, the gear teeth shape can be designed to improve flow rates and pressures. For example, a fourteen and one half inch gear size can comprise a twenty-degree tooth angle. As another example, a courser gear tooth ratio may provide for improved flow rates and pressures for certain implementations. An involute gear tooth profile may also provide for improved operation. In one or more of these examples, if the gear geometry is changed the housing may need to be changed as well.

In the example implementation, the example pump 100 can comprise a bracket foot 126 and a casing foot 128. The bracket foot 126 can be part of or fixed to the bracket 114; and the casing foot 128 can be fixed to or part of the casing head 122. In this implementation, the bracket foot 126 and casing foot 128 can be used to fasten the pump 100 to a stationary platform, such as at the location where pumping of the product is desired. That is, for example, the respective feet 126, 128 can comprise fastening vias that allow a fastener to pass through to fasten to the stationary platform, in order to hold the pump 100 to the platform.

FIGS. 2*a*-2*d* are component diagram illustrating one implementation of an example pipeline injection pump 200 comprising two sets of external pumping gears. As illustrated, the example double gear pump 200 comprises a second driver gear 230 and a second driven gear 232, respectively, operably fixed to the driver shaft 202 and a second driven shaft 236. As an example, the addition of a second set of pumping gears can provide for a significant increase in pumping ability (e.g., flow rates and volumes), up to double the capacity of a single gear pair. In this implementation, the modular design of the bracket 214, first gear casing 216, second gear casing 220, separator plate 218, and casing head 222, allow for modular addition of gear sets. For example, as illustrated, the bracket 214 may be the same design/type (or same) bracket 114 found in the example pump 100 of FIG. 1; and the first gear casing 216 may be the same design/type (or same) gear casing 116 found in the example pump 100 of FIG. 1. In this example, in this modular design, the separator plate 218, the second gear casing 220, and casing head 222 can be fixedly engaged with the bracket 214 and first gear casing 216 of the same design to create the new, double gear pump 200.

Further, in this example implementation, the pump 200 can comprise a driver shaft 202 that is longer than the driver shaft 102 of pump 100, in order to accommodate the second set of pump gears 230, 232. Further, the example pump 200 comprise a first driven shaft 234, which is operably, fixedly engaged with the first driven gear 210. The example, pump 200 comprises a second driven shaft 236, which is operably, fixedly engaged with the second driven gear 232. In this example, a bearing housing 204 can comprise a bearing assembly 224, which may help stabilize the driver shaft 202, by mitigating axial and radial movement. Additionally, a seal 206 may be engaged with the shaft 202 at a location where the shaft 202 enters the pump housing 250. The seal can mitigate leakage of a pump fluid from inside the pump to the outside of the pump 200.

In this implementation, the separator plate 218 of the example, pump 200 can comprise a first port 212*a* and a second port 212*b*. The first port 212*a* and second port 212*b* are in fluid communication with the first gear casing 216 and second gear casing 220, such that fluid pumped by the by the respective gears 208, 210, 230, 232 inside the respective gear casing 216, 220, may be drawn in through one of the ports and out of the other port, depending on the orientation of the pump. That is, for example, the first port 212*a* can comprise an outlet or discharge port, and the second port 212*b* can comprise an inlet or suction port, such as when the pump is oriented in a clockwise (CW) orientation. Further, for example, the first port 212*a* can comprise the inlet or suction port, and the second port 212*b* can comprise outlet or discharge port, such as when the pump is oriented in a counter-clockwise (CCW) orientation. As described above for the casing head 122 in FIG. 1, in one implementation, the separator plate 218 may comprise a modular design that allows it to be rotated one-hundred and eighty degrees around its central axis to provide appropriate CW and CCW markings for the installer of the pump. These markings allow the installer to readily view on which side the suction and discharge ports are disposed, based on the CW or CCW orientation of the pump.

Additionally, the example, pump 200 can comprise a bracket foot 226 and a casing foot 228. The bracket foot 226 can be part of or fixed to the bracket 214; and the casing foot 228 can be fixed to or part of the casing head 222. In this implementation, the bracket foot 226 and casing foot 228 can be used to fasten the pump 200 to a stationary platform, such as at the location where pumping of the product is desired. That is, for example, the respective feet 226, 228 can comprise fastening vias that allow a fastener to pass through to fasten to the stationary platform, in order to hold the pump 200 to the platform.

Figure 3:
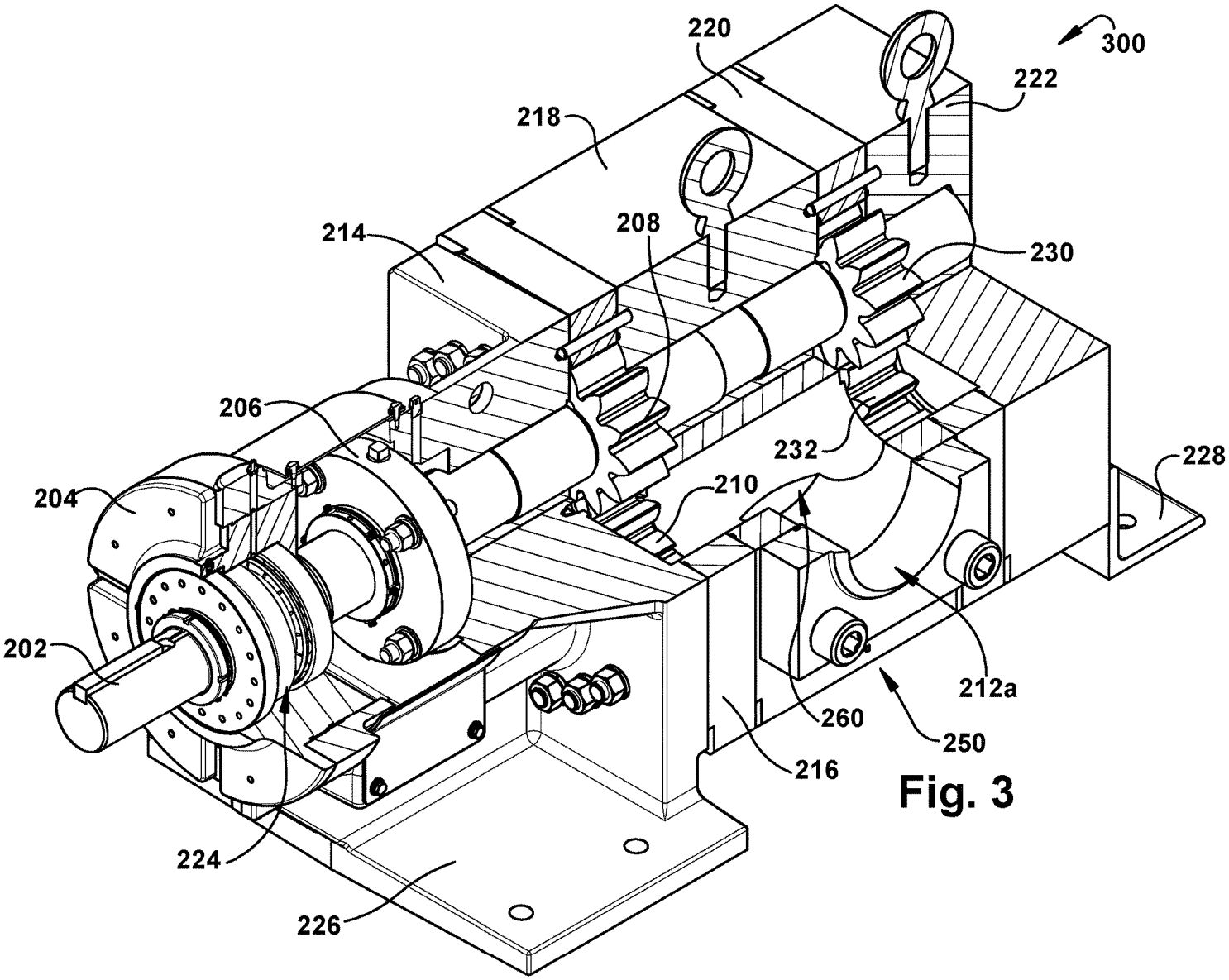
FIG. 3 is a component diagram illustrating an example implementation of one or more portions of one or more systems described herein.

FIG. 3 is a component diagram illustrating a cut-away perspective view of one implementation of an example double gear set pump 300. In this implementation, the respective parts of the pump are numbered according to the FIGS. 2*a*-2*b*. Further, FIG. 3 illustrates a first pumping chamber 260 disposed in the separator plate 218 of the pump housing 250. As illustrated, the first pumping chamber 260 is fluidly coupled with the first gear casing 216 and the second gear casing 220, and is fluidly coupled with the first port 212*a*. Further, although not illustrated, the separator plate 218 can comprise a second pumping chamber, which is disposed on the opposite side of the separator plate 218. The second pumping chamber is fluidly coupled with the first gear casing 216 and second gear casing 220, and is fluidly coupled with the second port 212*b*. In this way, for example, the first and second driver gears 208, 230 can be rotated by the driver shaft 202, resulting in rotation of the first and second driven gears 210, 232 that are meshedly engaged with the first and second driver gears 208, 230. In this example, the rotation of the meshed gears results in fluid to be drawn into the suction port (e.g., 212*b*), into the second pumping chamber, through internal chamber in the respective gear casings 216, 220, between respective gears, out into the first pumping chamber 260, and out the discharge port (e.g., 212*a*).

Figure 4:
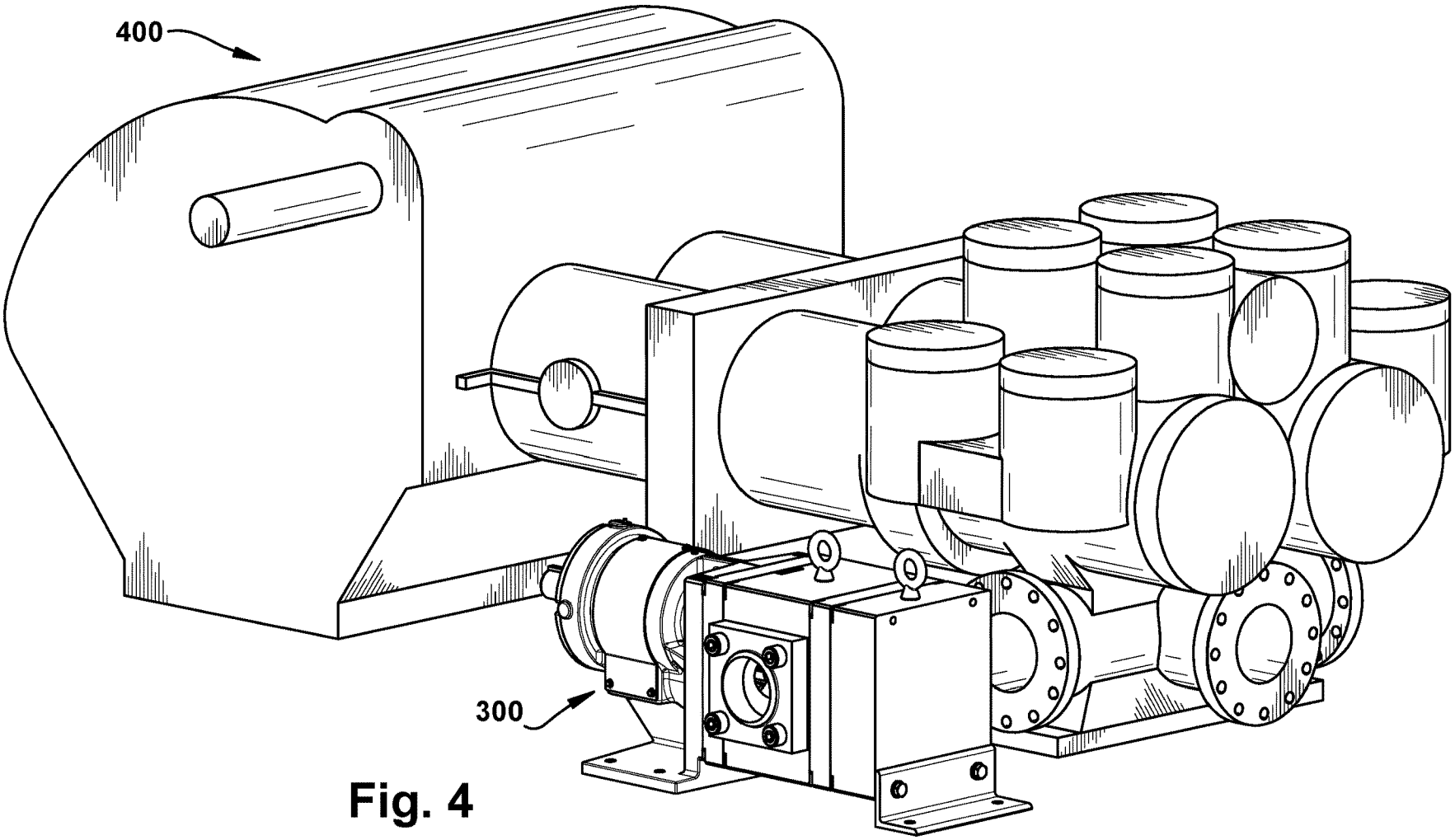
FIG. 4 is a component diagram illustrating an example embodiment where one or more portions of one or more systems, described herein, may be implemented.
Figure 5:
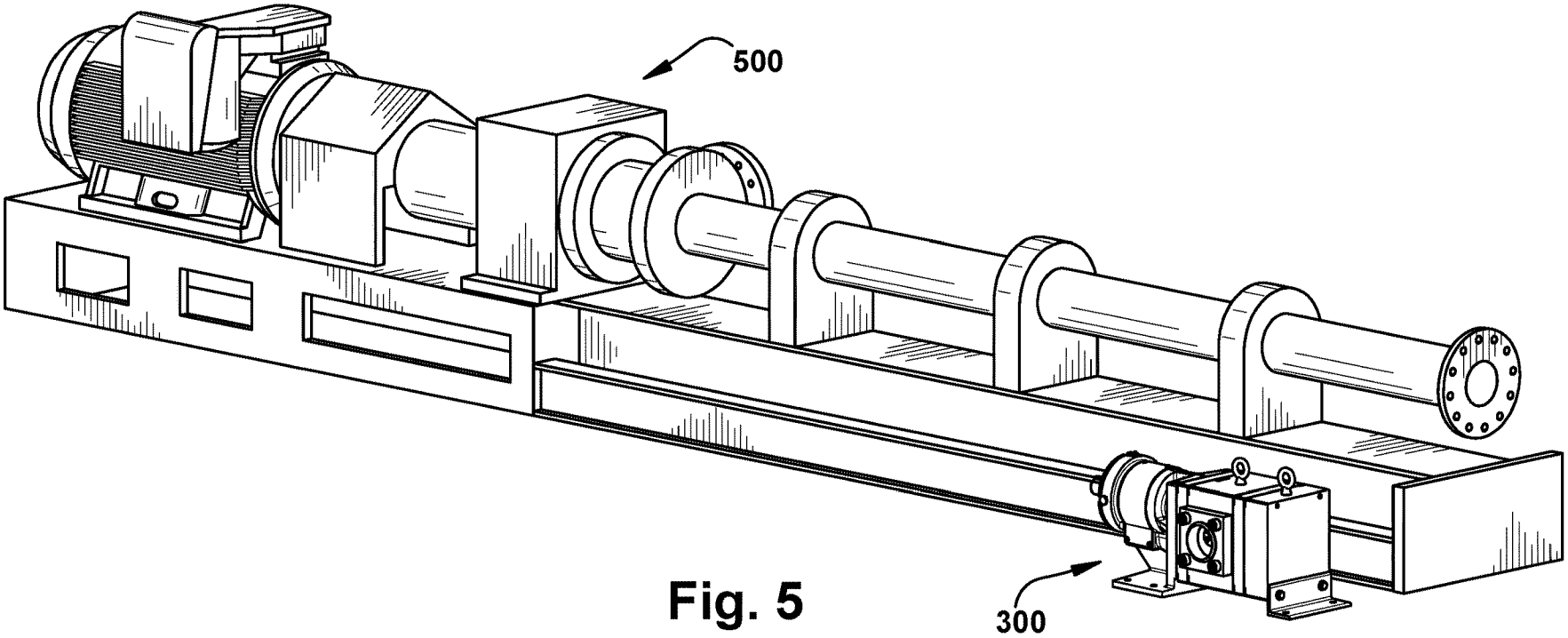
FIG. 5 is a component diagram illustrating an example embodiment where one or more portions of one or more systems, described herein, may be implemented.
Figure 6B:
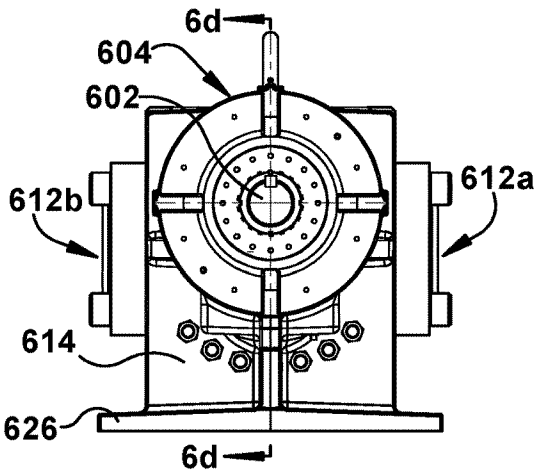
FIGS. 6*a*, 6*b*, 6*c*, and 6*d* are component diagrams illustrating various views of yet another implementation of an example external gear pump that may be used for pipeline injection.
Figure 6A:
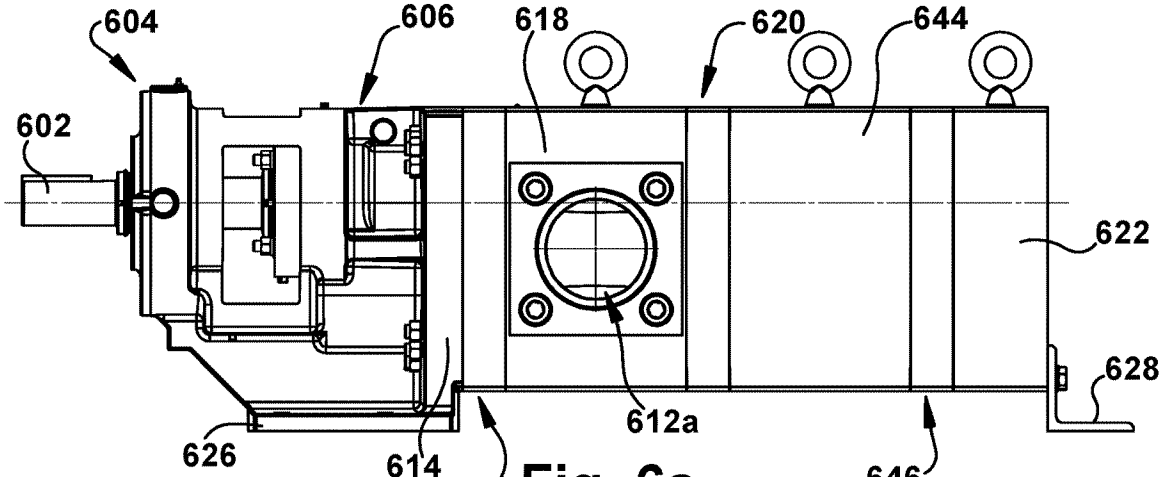
Figure 6C:
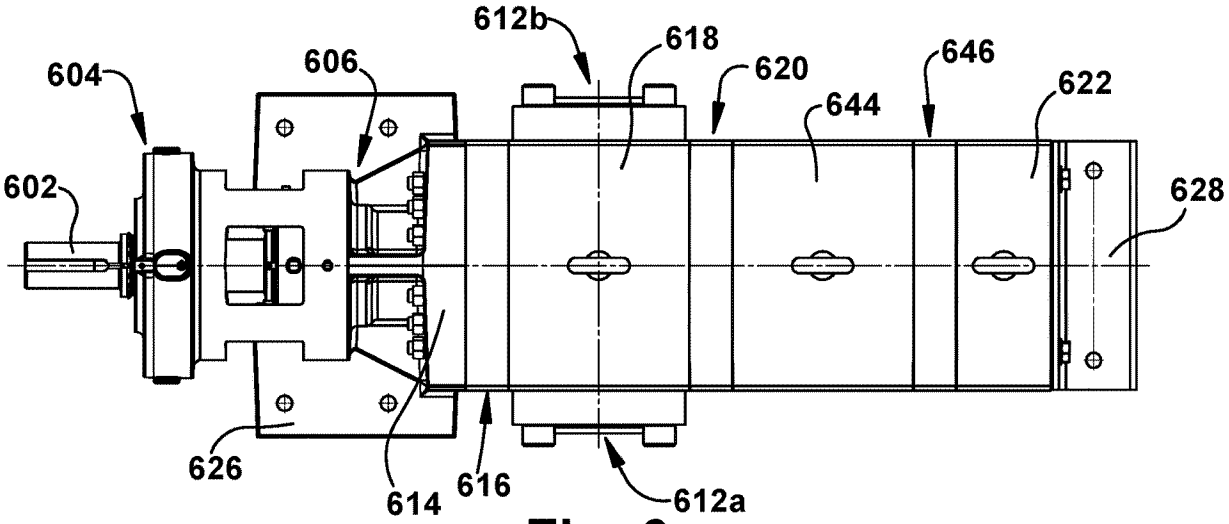
Figure 6D:
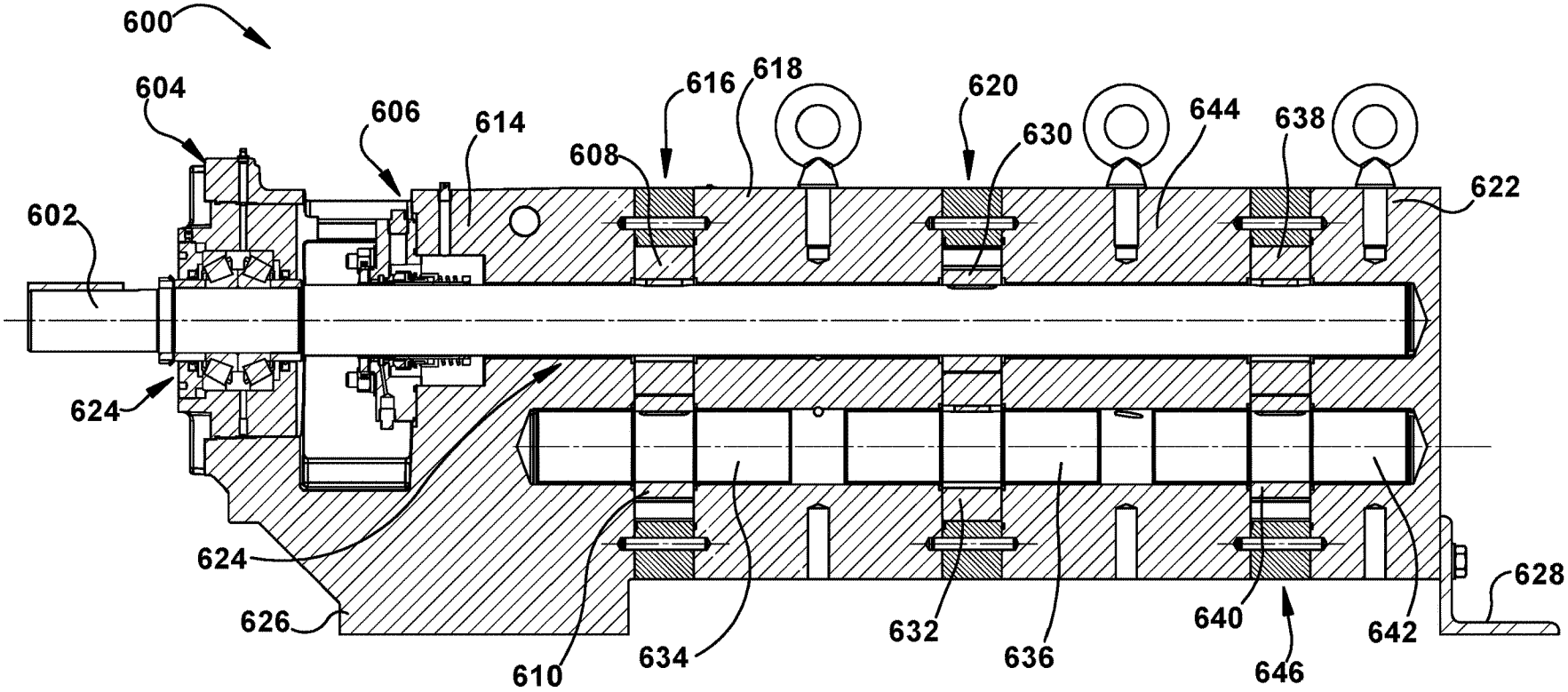
Figure 7B:
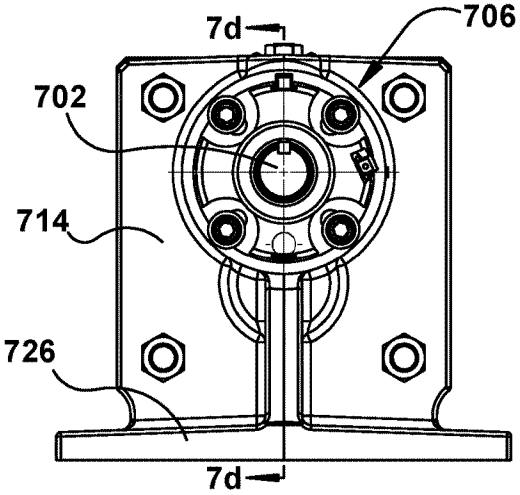
FIGS. 7*a*, 7*b*, 7*c*, and 7*d* are component diagram illustrating various view of one implementation of an example external gear pump that may be used for LACT purposes.
Figure 7D:
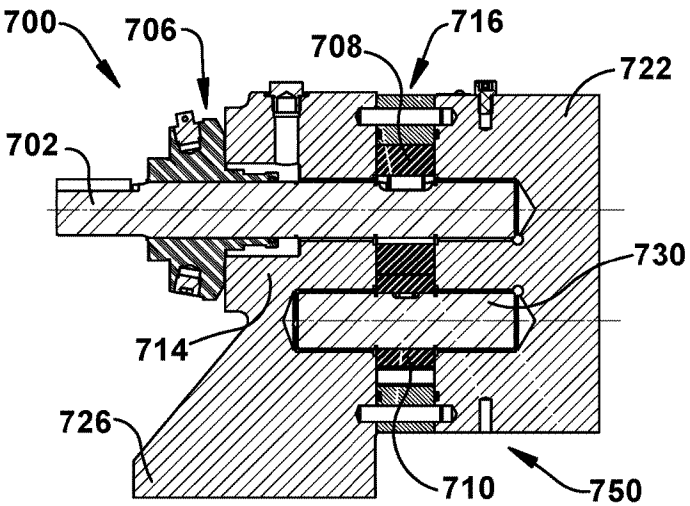
Figure 7A:
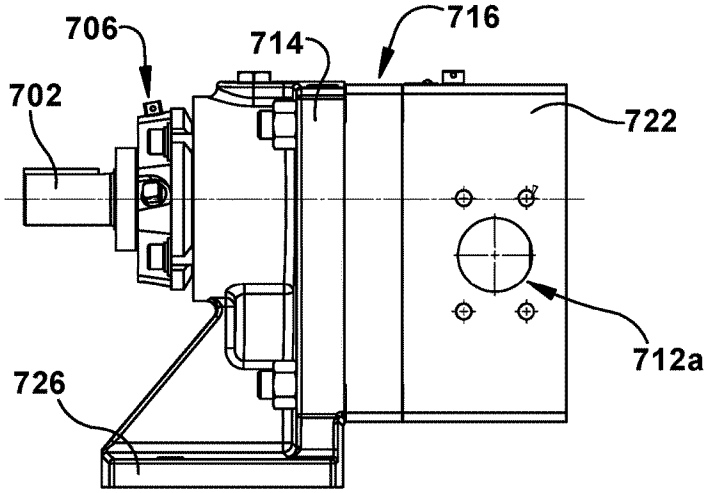
Figure 7C:
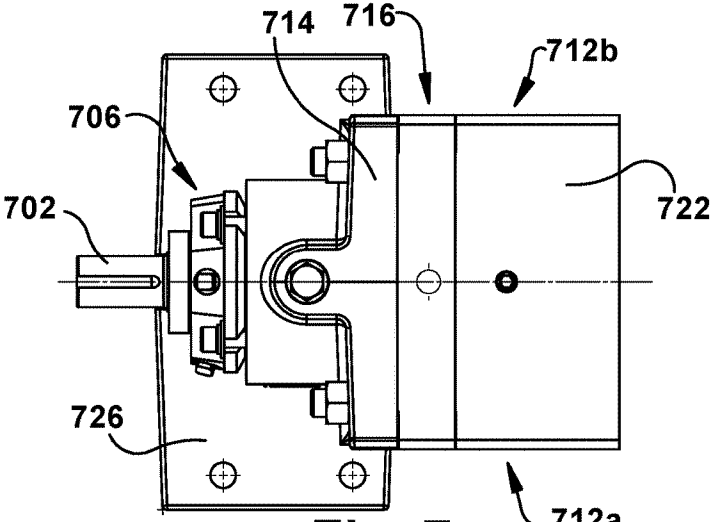
Figure 8A:
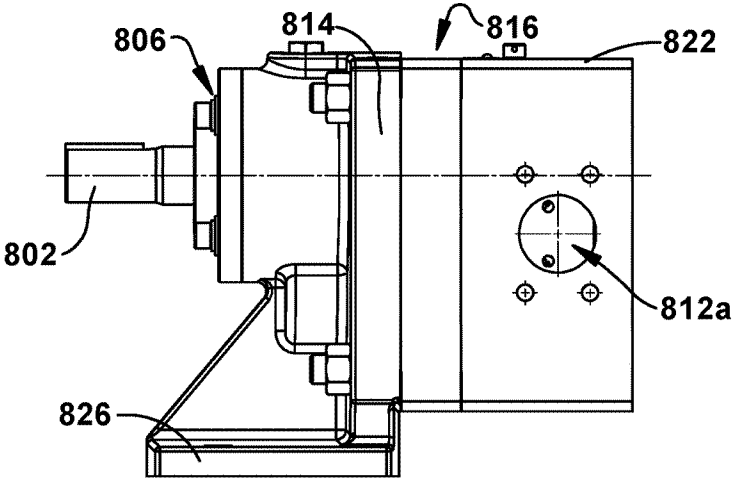
FIGS. 8*a*, 8*b*, 8*c*, 8*d*, and 8*e* are component diagram illustrating various view of another implementation of an example external gear pump that may be used for LACT purposes.
Figure 8B:
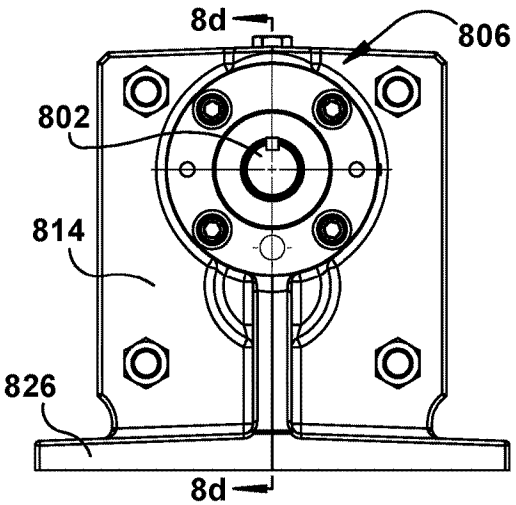
Figure 8C:
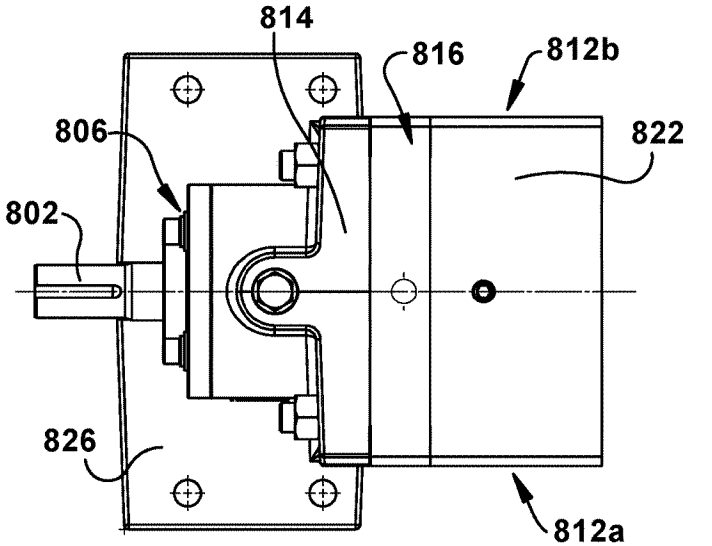
Figure 8D:
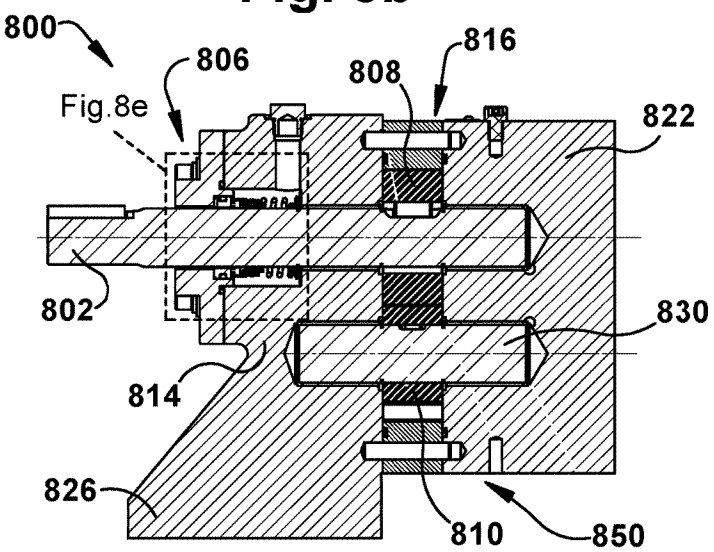
Figure 8E:
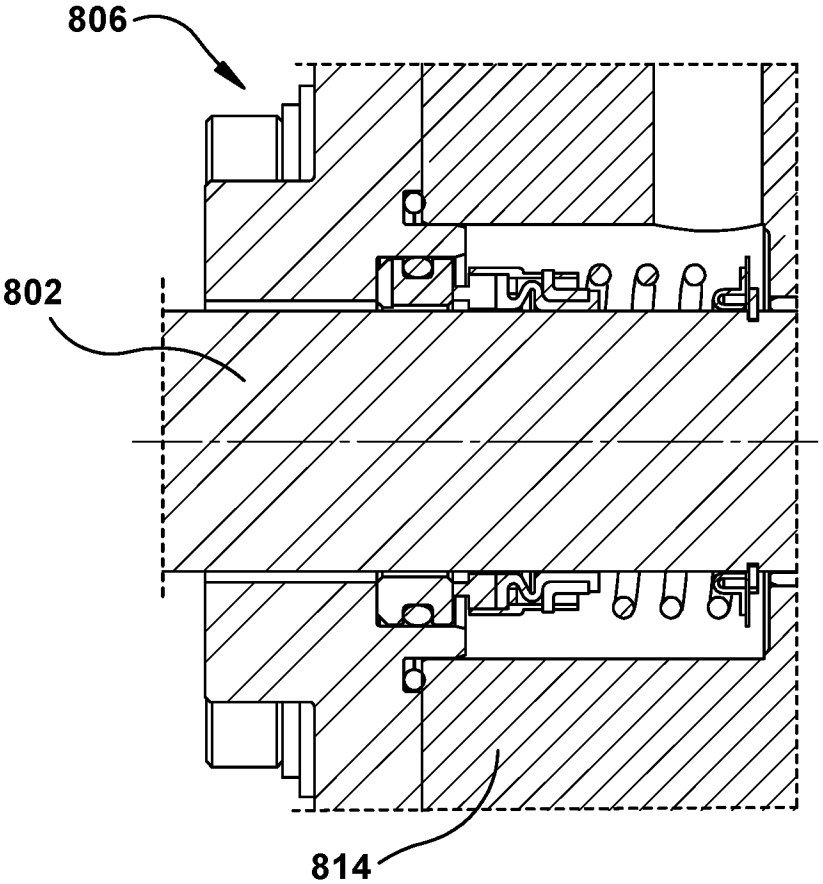
Figure 9B:
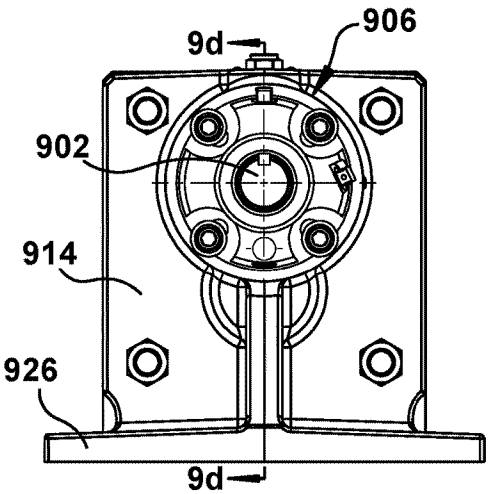
FIGS. 9*a*, 9*b*, 9*c*, and 9*d* are component diagram illustrating various view of yet another implementation of an example external gear pump that may be used for LACT purposes.
Figure 9A:
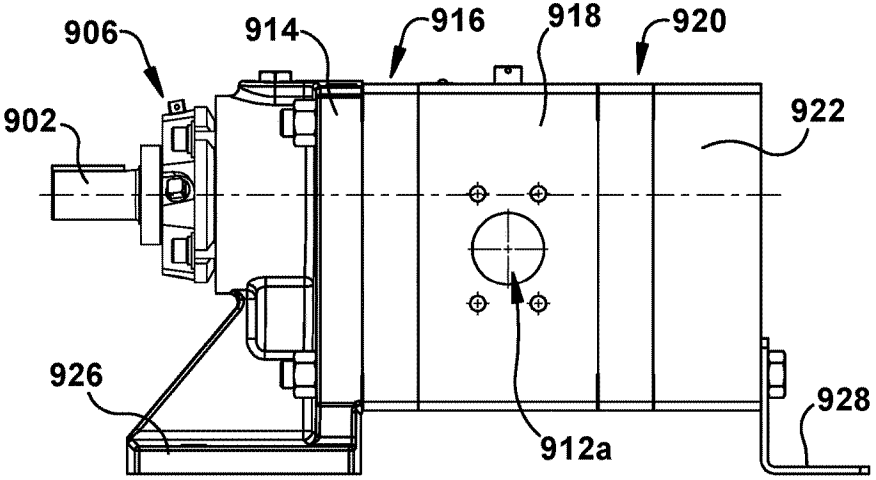
Figure 9C:
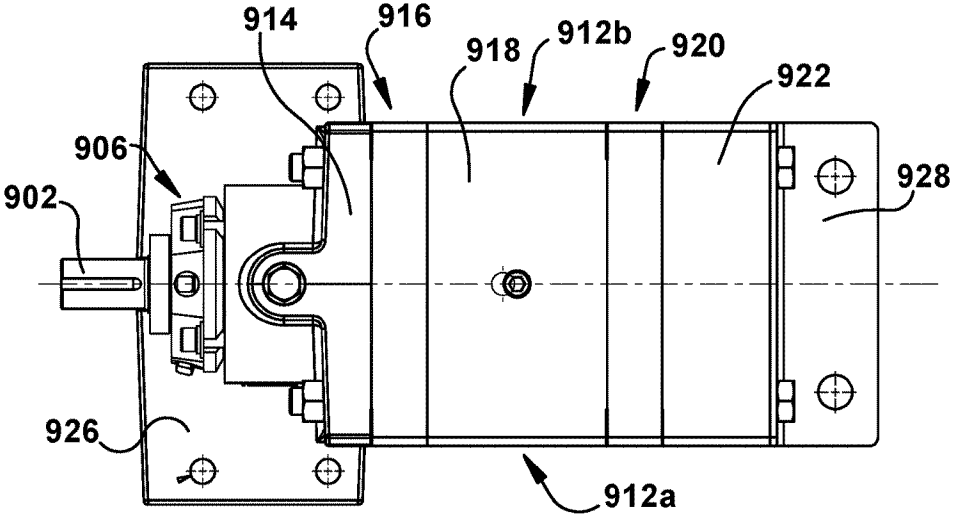
Figure 9D:
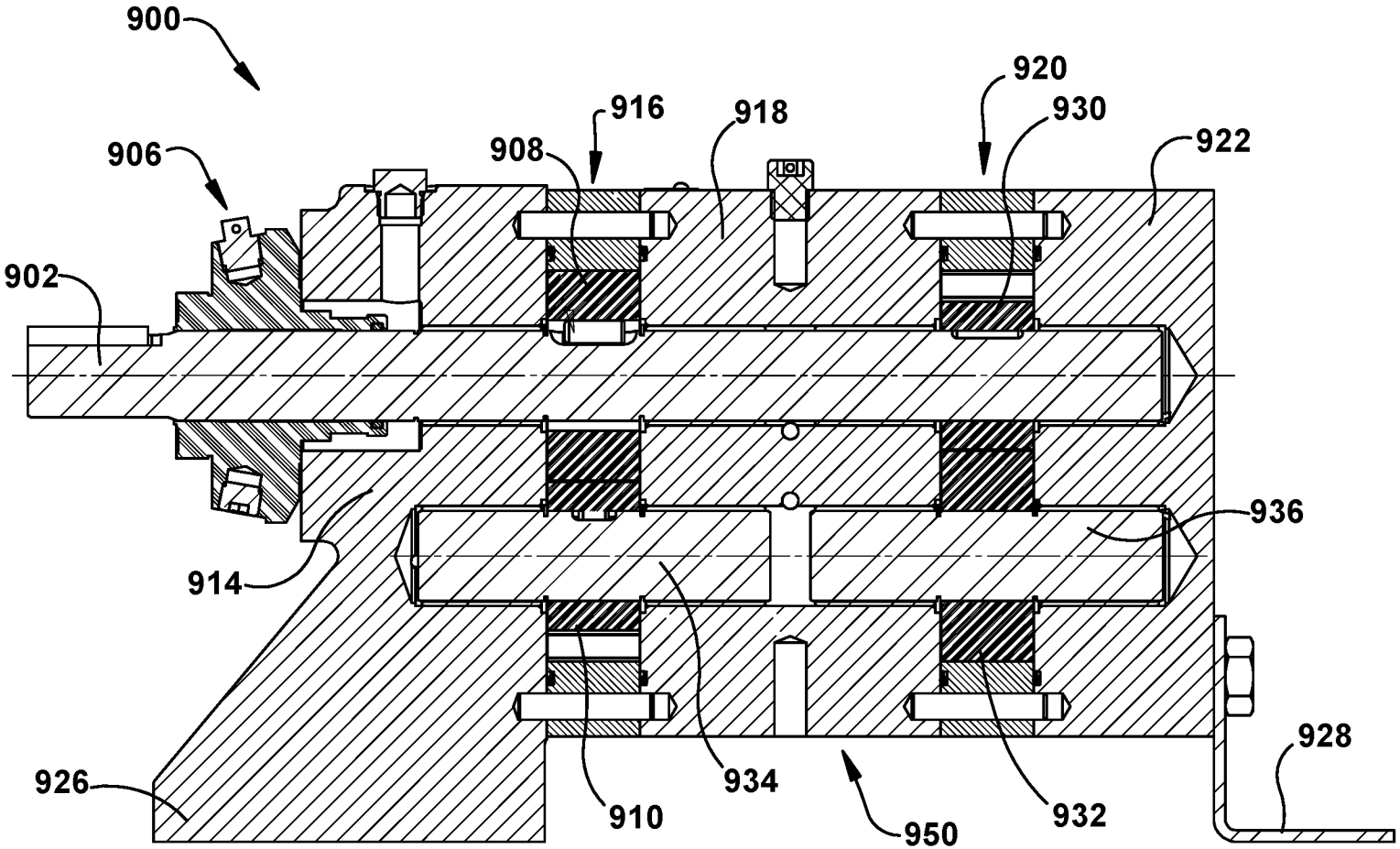

FIGS. 4 and 5 are component diagrams illustrating differences between the example innovative pump 300, described herein, and existing pumps 400, 500 used for similar situations. As illustrated in FIG. 4, the example innovative pump 300, described herein, can provide a much smaller footprint than an existing reciprocating style or piston style pump 400, which may be used for pipeline injection situations. Further, as illustrated in FIG. 5, the example innovative pump 300, described herein, can provide a much smaller footprint than an existing centrifugal style pump 400, which may be used for pipeline injection situations. Additionally, the example pump 300, described herein, can provide for improved flow rates and pressure ratings. For example, this type of pump 100, 200, 300 may be used to move a fluid product at up to 1,500 PSI or more through a pipeline; and may be able to generate a flow rate of up to 15,000 barrels per day or more. In another implementation, the pump 100, 200, 300 may be used to move a fluid product at about 500 PSI or any incremental pressure amount up to 1,500 PSI. In one implementation, a six-hundred horsepower motor may be implemented to power the driver shaft to achieve this type of flow rate and pressure, while maintaining a smaller footprint. As another example, the external gear design (e.g., 300) can help eliminate the need for pulsation dampeners, gear reducers, belt drives, or additional equipment to service and maintain, which is typically needed when operating a reciprocating/piston 400 or centrifugal style pump 500 existing today.

FIGS. 6*a*-6*d* are component diagram illustrating one implementation of an example pipeline injection pump 600 comprising three sets of external pumping gears. As illustrated, the example triple gear pump 600 comprises a first driver gear 608, second driver gear 630, and third driver gear 638. Further, the example pump 600 comprises a first driven gear 610, a second driven gear 632, and a third driven gear 640. The respective driver gears 608, 630, 638 are respectively, operably fixed to the driver shaft 602, which is longer that the single and double gear pump driver shafts 102, 202. The driven gears 610, 632, and 640 are operably fixed to a first driven shaft 634, a second driven shaft 636, and a third driven shaft 642, respectively. As an example, the addition of a third set of pumping gears 638, 640 can provide for a significant increase in pumping ability (e.g., flow rates and volumes), up to triple the capacity of a single gear pair.

In this implementation, the modular design of the bracket 614, first gear casing 616, second gear casing 620, a first separator plate 618, a second separator plate 644, and the casing head 622, allows for modular addition of the gear sets. For example, as illustrated, the bracket 614 may be the same design/type (or same) bracket 114, 214 found in the example pumps 100, 200 of FIGS. 1 and 2. Further, the first gear casing 616 and second gear casing 620 may be the same design/type (or same) gear casings 116, 216, and 220 found in the example pumps 100 and 200. In this example, in this modular design, the second separator plate 644, the third gear casing 638, and casing head 622 can be fixedly engaged with the bracket 614, first gear casing 616, first separator plate 618, and second gear casing 620, of the same design to create the new, triple gear pump 600.

In this example, a bearing housing 604 can comprise a bearing assembly 624, which may help stabilize the driver shaft 602, by mitigating axial and radial movement. In this implementation, the driver shaft is longer than that of the single gear pair, and double gear pair pumps 100, 200. The bearing assembly, in combination with the tight tolerance and clearances between the driver shaft 602 and the driver shaft cavity 658 (e.g., cavity in the bracket 614, first gear casing 616, first separator plate 618, second gear casing 620, second separator plate 644, third gear casing 646, and casing head 622) in the pump housing 650, helps mitigate the effects of axial and radial movement or force applied to the shaft 602 under load. This allows for more efficient pumping, and less wear on the parts of the pump. Additionally, a seal 606 may be engaged with the shaft 602 at a location where the shaft 602 enters the pump housing 650. The seal can mitigate leakage of a pumped fluid from inside the pump (e.g., along the driver shaft cavity 658) to the outside of the pump 600.

In this implementation, the first separator plate 618 of the example pump 600 can comprise a first port 612*a* and a second port 612*b*. The first port 612*a* and second port 612*b* are in fluid communication with the first gear casing 616, the second gear casing 620, and the third gear casing 646, such that fluid pumped by the respective gears 608, 610, 630, 632, 638, 640 inside the respective gear casing 616, 620, 646 may be drawn in through one of the ports and out of the other port, depending on the orientation of the pump. That is, for example, the first port 612*a* can comprise an outlet or discharge port, and the second port 612*b* can comprise an inlet or suction port, such as when the pump is oriented in a clockwise (CW) orientation. Further, for example, the first port 612*a* can comprise the inlet or suction port, and the second port 612*b* can comprise outlet or discharge port, such as when the pump is oriented in a counter-clockwise (CCW) orientation.

As described above for the casing head 122 in FIG. 1 and separator plate 218 on FIG. 2, in one implementation, the separator plate 618 may comprise a modular design that allows it to be rotated one-hundred and eighty degrees around its central axis to provide appropriate CW and CCW markings for the installer of the pump. These markings allow the installer to readily view on which side the suction and discharge ports are disposed, based on the CW or CCW orientation of the pump. In one implementation, the second separator plate con comprise the first port 612*a* and the second port 612*b*. In this implementation, the first separator plate may not comprise any ports.

Further, the pump housing 650 can comprise a first pump chamber (not illustrated) that is fluidly coupled with the first port 612*a*, and a second pump chamber (not illustrated) that is fluidly coupled with the second port 612*b*. In one implementation, the first pump chamber can be fluidly coupled with discharge side of the respective gear casings 616, 620, 646; further, the second pump chamber can be fluidly coupled with the suction side of the respective gear casings 616, 620, 646. In this way, in one example, fluid can be drawn in through the second port, into the second chamber, through the respective gear casings 616, 620, 646, through the gears, into the first pump chamber, and out the discharge port 612*a*.

Additionally, the example, pump 600 can comprise a bracket foot 626 and a casing foot 628. The bracket foot 626 can be part of or fixed to the bracket 614; and the casing foot 628 can be fixed to or part of the casing head 622. In this implementation, the bracket foot 626 and casing foot 628 can be used to fasten the pump 600 to a stationary platform, such as at the location where pumping of the product is desired. That is, for example, the respective feet 626, 628 can comprise fastening vias that allow a fastener to pass through to fasten to the stationary platform, in order to hold the pump 600 to the platform.

In one implementation, a Lease Automatic Custody Transfer ("LACT") system can be devised to transfer custody of a petroleum product from a collection site (e.g., a landowner's site of oil production/collection) to a pipeline used to transport the petroleum product, through or from a metering apparatus used to meter the flow of the product. For example, a LACT pump system as described herein can be used to push the product against high pressures into the pipeline. That is, in this example, a pipeline that transports crude oil can be under high pressure due to the type and amount of product being transported, and the length of the pipeline to a destination (e.g., collection point). Therefore, in this example, the LACT pump may need to push the product at higher pressures to inject it into the transport pipeline effectively.

FIGS. 7-11 are component diagrams illustrating several example implementations of LACT pumps 700, 800, 900, 1100, which may be used to push product to a transport pipeline. Example pump 700 is a single gear pair, external gear pump in a clockwise (CW) orientation; example, pump 800 is a single gear pair, external gear pump in a counter-clockwise (CCW) orientation; example pump 900 is a double gear pair, external ear pump; and example, pump 1100 is a triple gear pair, external gear pump. In these implementations, the example, pumps are configured with modular parts that can be used to extend the pumps from a single gear pair, to a double and triple gear pair using the same parts. That is, for example, the respective pumps can comprise the same (e.g., of the same design) bracket 714, 814, 914, 1114 in any of the configurations, whether single, double or triple, and CW or CCW. Further, for example, the respective pumps can comprise the same (e.g., of the same design) gear casings 716, 816, 916, 1116 as a first gear casing; and/or the same gear casing 920, 1120, 1146 as the second or third gear casings. Additionally, for example, the respective pumps can comprise the same (e.g., of the same design) separator plates comprising a first and second port 918, 1118. That is, the respective parts may be interchangeable between respective pump designs, and orientations.

In one implementation, as illustrated in FIG. 7*a*-7*d*, an example pump 700 can comprises a driver shaft 702, and a back pull out seal 706. For example, a back pull-out pump seal design can be configured for rapid dismantling and re-assembly. In this implementation, the pump 700 with the back pull-out seal 706 can be used in petroleum product pumping, such as for process pumps. For example, the advantage of this design is that the rotating assembly, including any bearings and shaft seals (e.g., 706) may be readily pulled out of the pump housing 750. In this example, this configuration allows internal components to be inspected and replaced without having to remove the casing from the piping or platform.

Further, in this implementation, the example pump 700 can comprise the driver gear 708, and a driven gear 710. In this implementation, the driver gear 706 can comprise a gear that is fixedly engaged with (e.g., press or friction fit, fastened, glued, welded, soldered, or otherwise attached to, or formed with, or fastened with a fastener or clip to) the shaft 702, such that when the shaft rotates the driver gear 706 rotates (e.g., the shaft applies torque to the driver gear 706). That is, for example, a motor (not pictured) drives the rotation of the shaft 702, which drives the rotation of the gear 706.

In this implementation, the gears 708, 710, and respective gears described herein, can comprise an improved material construction that provides for improved operation, less maintenance, longer operational life, and lower overall cost. For example, the improved materials can comprise harder gears and gear teeth, such as hardened steel, steel alloys, and other metals that resist abrasion and other damage. In one implementation, one or more components of the respective pumps described herein can be Vitek hardened to increase wear resistance. Further, the pump parts, including the gears, gear teeth, heads, casings, drive shaft, seal, bearings, and bushings can be formed with tighter tolerances and clearance (e.g., gaps) than previously found in these types of pumps. The improved tolerances can help provide improved pressure ratings, a smaller footprint, and improved overall operational life.

Additionally, the example pump 700 can comprise one or more ports 712, for example, with one or more bolt attachment components. The pump 700 can comprise a first port 712*a* and a second port 712*b*. For example, the first port 712*a* may be an outlet or discharge port, and the second port 712*b* may be an inlet port, when the pump 700 is disposed in a CW orientation. As illustrated in FIGS. 8A-8*d*, the example, pump 800 can comprise a first port 812*a* and a second port 12*b*. For example, the first port 812*a* may be an inlet or suction port, and the second port 712*b* may be an outlet or discharge port, when the pump 800 is disposed in a CCW orientation The example pump 700 can also comprise a gear casing the bracket 714, a gear casing 716, and a head casing 722. Further, as illustrated in FIGS. 7-11 the various implementations of the LACT pump comprise merely one mechanical seal 706, 806, 906, 1106, with the opposing end of the driver shaft 702, 802, 902, 1102 contained internally to the pump housing 750, 850, 950, 1150. This type of arrangement can help reduce abrasive wear and mitigate leakage. Further, in these examples, a suck back system can be implemented, that is vented to the inlet side or suction side of the pump. Additionally, in these examples, one or more thrust bearing components can be implemented in higher-pressure situations.

In these examples, the innovative bracket 714, 814, 914, 1114 can be used to hold the seal 706, 806, 906, 1106, and provide for shaft support in order to mitigate axial and radial movement when forces are applied to the shaft under load. Further, for example, the same bracket 714, 814, 914, 1114 can be utilized while a different seal may be introduced for various gear types and numbers of gears. Additionally, for example, utilizing this innovative bracket design, additional gear sections can be stacked (e.g., 900 if FIG. 9, 1100 in FIG. 11) with a longer drive shaft to add more bearings to support the shaft and reduce pressure on the bearings. In this implementation, this allows additional gear sections to be added to increase flow pressure and/or flow rate, without increasing the size (e.g., diameter) of the pump, which would occur in an existing system that merely increase the gear size. This design allows for maintaining substantially constant pressure and flow rates.

In some examples, the innovative head and separation plate design allows the casings to be rotated without changing the heads or separation plates. For example, this allows a user to rotate the casing to provide for either CW or CCW rotation in the same pump. In some implementations, visual indicators (e.g., markings such as stamping, labels, etc.) may be provided to allow the user to set up the pump in the desired CW or CCW rotation. Further, this innovative design allows the designer of the pump installation to place the pump system in an appropriate position for the site situation. For example, the user can merely disassemble the pump and set the configuration that is appropriate for the situation, without needing to replace additional parts in the pump.

Figure 10:
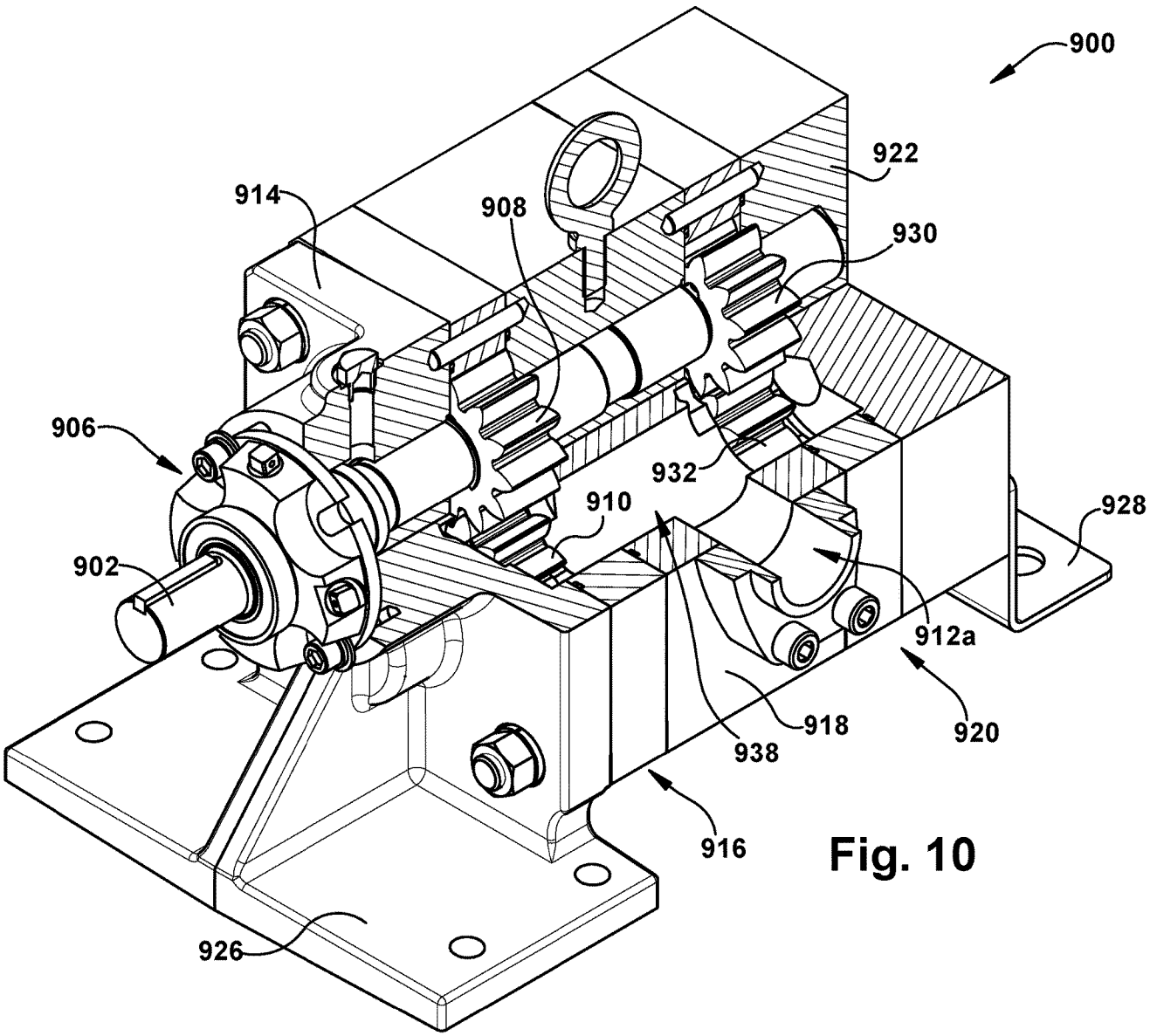
FIG. 10 is a component diagram illustrating an example implementation of one or more portions of one or more systems described herein.
Figure 11B:
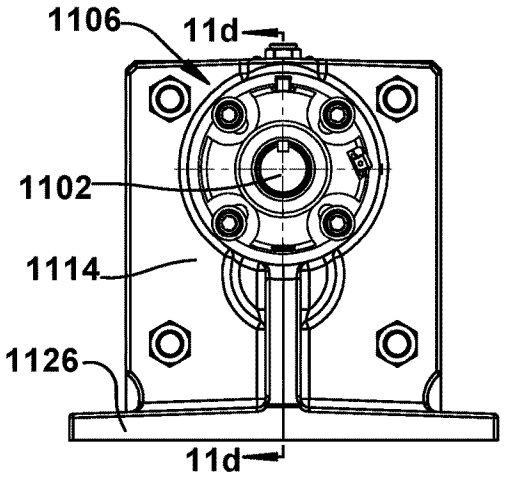
FIGS. 11*a*, 11*b*, 11*c*, and 11*d* are component diagram illustrating various view of yet another implementation of an example external gear pump that may be used for LACT purposes.
Figure 11A:
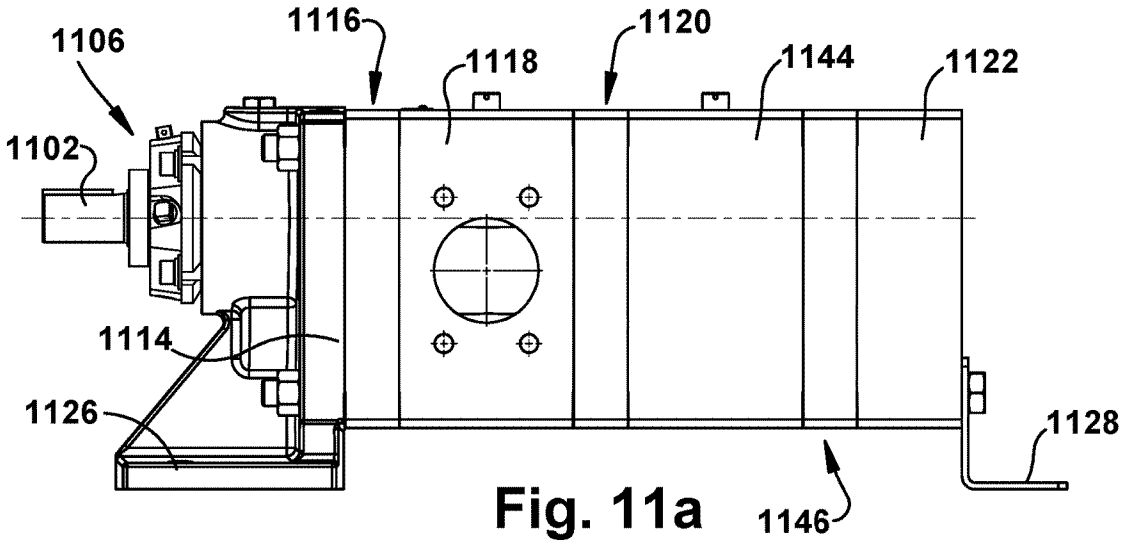
Figure 11C:
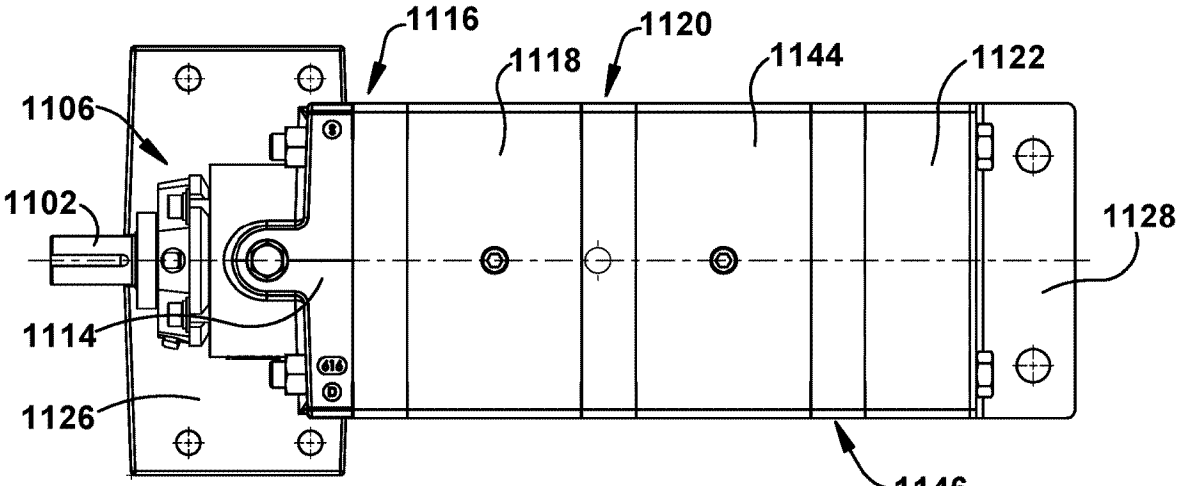
Figure 11D:
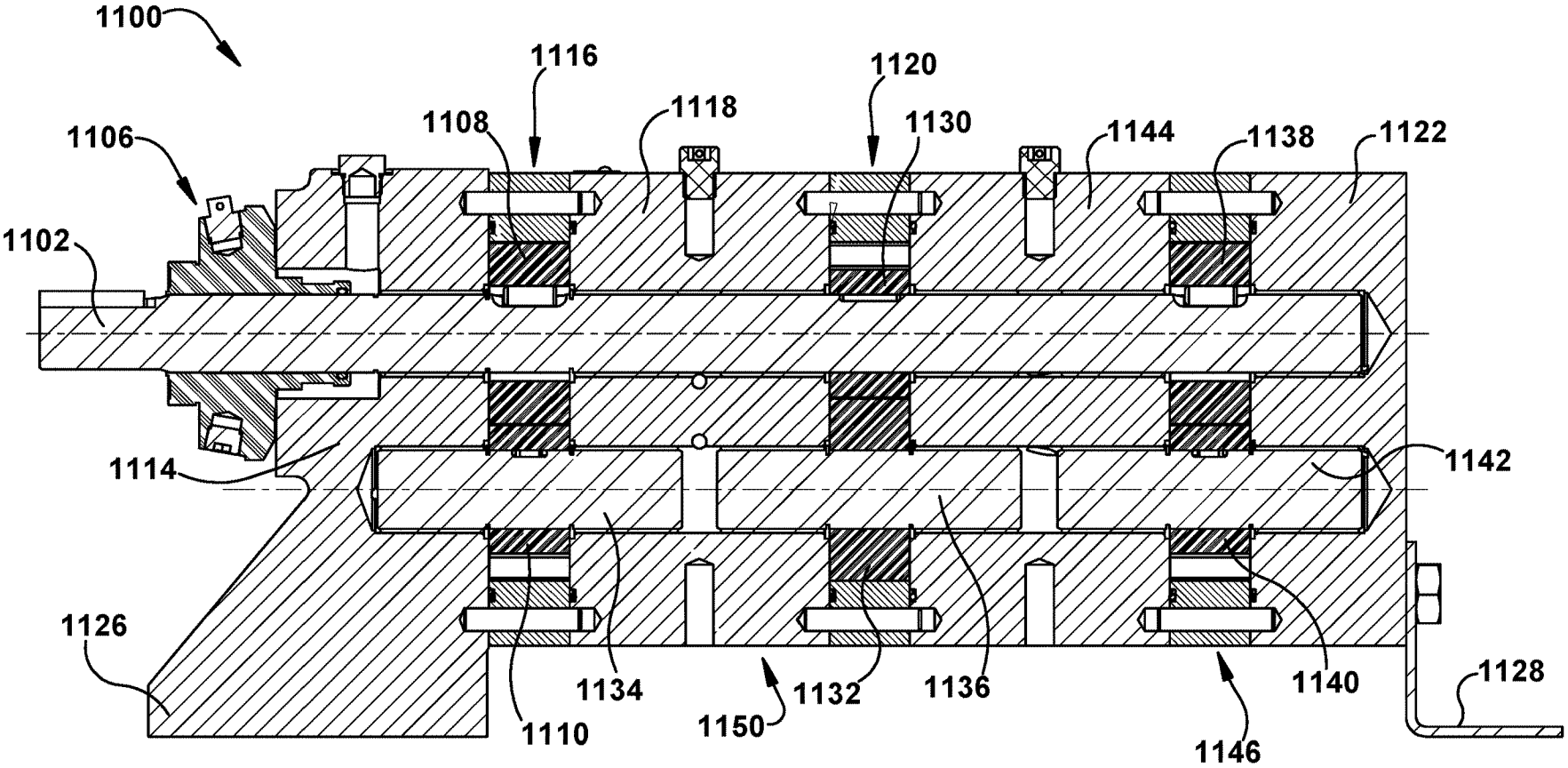

As illustrated in FIGS. 7-11, the respective pumps 700, 800, 900, 1100 can comprise the pump housing 750, 850, 950, 1150, respectively comprising at least a bracket 714, 814, 914, 1114, and a casing head 722, 822, 922, 1122. In the single gear pair pumps 700, 800, the casing head 750, 850 comprises the first port 712*a*, 812*a*, and second port 712*b*, 712*b*, and a first pumping chamber and second pumping chamber inside the housing (not shown). The double gear pump 950 further comprises a second gear casing 920 with the first gear casing 916, and a separation plate 918. In this implementation, as illustrated in FIG. 10, the separator plate 918 comprises the first pumping chamber 938, and a second pumping chamber (not shown) disposed on the opposite side of the separator plate. Further, the head casing 922 merely comprises a cavity to hold the driver shaft 902. The first and second ports 912*a*, 912*b* are in fluid communication respectively with the first 938 and second pumping chambers; and are in fluid communication with the internal chamber of the gear casings 916, 920. In this way, the rotation of the gears provides for fluid to be drawn into the inlet port (e.g., 912*b*) through the second pumping chamber, the gear casings 916, 920, into the first pumping chamber 938, to the outlet port (e.g., 912*a*).

As illustrated in FIG. 11, the triple gear pump 1100 also comprises a third gear casing 1146, along with the first and second gear casings 1116, 1120. Further, the pump 1100 comprises a second separator plate 1144, along with the first separator plate 1118. In this implementation, the firs separator plate comprises the first and second ports 1112*a*, 1112*b*. As an example, the head casing 1122 can be of the same design (e.g., or the same) as the casing 922 of FIG. 9. Additionally, respective pumps 700, 800, 900, 1100 can comprise a bracket foot 726, 826, 926, 1126, which can be used to secure the pump to a platform or location. Further, pumps 900 and 1100 can comprise a casing foot 928, 1128, which can also be used to secure the pump to a platform or location.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, At least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A pump for use in a high pressure pipeline, comprising:

a pump bracket comprising:

a bearing housing disposed proximate a motor coupling end of the pump, the bearing housing operably holding a bearing assembly that provides support to a pump driver shaft from axial and radial force applied to the driver shaft under load;

a seal chamber disposed distally from the bearing housing, the seal chamber holding a selectably removable seal that is fixedly engaged with the driver shaft during operation to mitigate leakage of a pumped fluid from inside a pump housing to outside the pump housing; and a drive shaft cavity running through the bracket, and configured to operably hold the driver shaft;

a first gear casing fixedly engaged with the bracket during operation, the first gear casing comprising a first gear chamber that operably holds a driver gear and a driven gear, the driver gear meshedly engaged with the driven gear engaged with a first driven shaft in the first gear chamber, and the driver gear operably fixedly engaged with the driver shaft such that the driver gear rotates when the driver shaft is rotated resulting in fluid being drawn into the first gear chamber on a first side, and discharged from the first gear chamber on a second side;

a first port and a second port disposed in the pump housing, the first port comprising a discharge port when the pump is disposed in a clockwise orientation and a suction port when the pump is disposed in a counter-clockwise orientation, and the second port comprising a suction port when the pump is disposed in a clockwise orientation and a discharge port when the pump is disposed in a counter-clockwise orientation;

a selectably removable first separator plate and a selectably removable second gear casing, the first separator plate operably disposed between the first gear casing and the second gear casing, and the first separator plate comprising the first port and the second port and comprising a first pumping chamber fluidly coupled with the first port and a second pumping chamber fluidly coupled with the second port, wherein the second gear casing comprises a second gear chamber housing a second driver gear operably, fixedly engaged with the driver shaft, and a second driven gear meshedly engaged with the second driver gear and engaged with a second driven shaft, wherein the first separator plate is configured to be rotated around its central axis that is parallel to the driver shaft such that the first port is operably disposed on the opposite side of the pump housing, and the first separator plate comprising an identifier that identifies whether the pump is disposed in a clockwise or counter-clockwise orientation; and a casing head disposed at the distal end of the pump, the casing head selectably, fixedly engaged with the gear casing and bracket, the casing head comprising a driver shaft end cavity to operably hold the driver shaft, the driver shaft end cavity closed at the distal end inside the casing head.

2. The pump of claim 1, the casing head comprising the first port and the second port, and further comprising a first pumping chamber disposed in fluid coupling with the first port and a second pumping chamber disposed in fluid coupling with the second port.

3. The pump of claim 2, the casing head configured to be rotated around its central axis that is parallel to the driver shaft such that the first port is operably disposed on the opposite side of the pump housing, and the casing head comprising an identifier that identifies whether the pump is disposed in a clockwise or counter-clockwise orientation.

4. The pump of claim 1, comprising a selectably removable second separator plate and a selectably removable third gear casing, the second separator plate operably disposed between the second gear casing and the third gear casing, wherein the third gear casing comprises a third gear chamber housing a third driver gear operably, fixedly engaged with the driver shaft, and a third driven gear meshedly engaged with the third driver gear and engaged with a third driven shaft.

5. The pump of claim 4, the second separator plate comprising a third pumping chamber fluidly coupled with the first pumping chamber, and a fourth pumping chamber fluidly coupled with the second pumping chamber.

6. The pump of claim 1, the bearing assembly comprising tapered roller thrust bearings to accommodate axial and radial loads applied to the driver shaft.

7. The pump of claim 1, the respective gears comprising a hardened steel or steel alloy that is resistant to abrasion.

8. The pump of claim 1, the first gear casing operably interchangeable with the second gear casing.

9. The pump of claim 1, the bracket comprising a bracket foot configured to secure the bracket to a platform.

10. A pump for use in a high pressure pipeline, comprising:

a pump housing;

a driver shaft operably coupled with a motor to rotate the driver shaft during operation;

a pump bracket comprising:

a drive shaft cavity running through the bracket, and configured to operably hold the driver shaft; and a bearing housing disposed proximate a motor coupling end of the pump, the bearing housing operably holding a bearing assembly that provides support to a pump driver shaft from axial and radial force applied to the driver shaft under load;

a seal assembly comprising:

a seal disposed inside the seal chamber immediately adjacent to the driver shaft to mitigate leakage of the pumped fluid; and a seal holder operably fixedly engaged with the driver shaft at the proximal end of the shaft, the seal holder operably holding the seal inside the seal chamber;

a first gear casing selectably, fixedly engaged with the bracket during operation, the first gear casing comprising a first gear chamber that operably holds a driver gear and a driven gear, the driver gear meshedly engaged with the driven gear engaged with a first driven shaft in the first gear chamber, and the driver gear operably fixedly engaged with the driver shaft such that the driver gear rotates when the driver shaft is rotated resulting in fluid being drawn into the first gear chamber on a first side, and discharged from the first gear chamber on a second side;

a first port and a second port disposed in the pump housing, the first port comprising a discharge port when the pump is disposed in a clockwise orientation and a suction port when the pump is disposed in a counter-clockwise orientation, and the second port comprising a suction port when the pump is disposed in a clockwise orientation and a discharge port when the pump is disposed in a counter-clockwise orientation; and a casing head disposed at the distal end of the pump and comprising the first port and the second port, and further comprising a first pumping chamber disposed in fluid coupling with the first port and a second pumping chamber disposed in fluid coupling with the second port, the casing head configured to be rotated around its central axis that is parallel to the driver shaft such that the first port is operably disposed on the opposite side of the pump housing, and the casing head comprising an identifier that identifies whether the pump is disposed in a clockwise or counter-clockwise orientation, the casing head selectably, fixedly engaged with the gear casing and bracket during operation, the casing head comprising a driver shaft end cavity to operably hold the driver shaft, the driver shaft end cavity closed at the distal end inside the casing head.

11. The pump of claim 10, the bearing assembly comprising tapered roller thrust bearings to accommodate axial and radial loads applied to the driver shaft.

12. The pump of claim 10, the bracket comprising a bracket foot configured to secure the bracket to a platform.

13. The pump of claim 10, the respective gears comprising a hardened steel or steel alloy that is resistant to abrasion.

14. A pump for use in a high pressure pipeline, comprising:

a pump housing;

a driver shaft operably coupled with a motor to rotate the driver shaft during operation;

a pump bracket comprising:

a drive shaft cavity running through the bracket, and configured to operably hold the driver shaft;

a bearing housing disposed proximate a motor coupling end of the pump, the bearing housing operably holding a bearing assembly that comprises tapered thrust bearings to provide support to a pump driver shaft from axial and radial force applied to the driver shaft under load;

a seal chamber disposed distally from the bearing housing, the seal chamber configured to operably hold a selectably removable seal to mitigate leakage of a pumped fluid from inside the pump housing to outside the pump housing; and a seal assembly comprising:

a seal disposed inside the seal chamber immediately adjacent to the driver shaft to mitigate leakage of the pumped fluid; and a seal holder operably fixedly engaged with the driver shaft at the proximal end of the shaft, the seal holder operably holding the seal inside the seal chamber;

a selectably removable first gear casing fixedly engaged with the bracket during operation, the first gear casing comprising a first gear chamber that operably holds a driver gear and a driven gear, the driver gear meshedly engaged with the driven gear engaged with a first driven shaft in the first gear chamber, and the driver gear operably fixedly engaged with the driver shaft such that the driver gear rotates when the driver shaft is rotated resulting in fluid being drawn into the first gear chamber on a first side, and discharged from the first gear chamber on a second side;

a selectably removable separator plate comprising a first port and a second port, the first port comprising a discharge port when the pump is disposed in a clockwise orientation and a suction port when the pump is disposed in a counter-clockwise orientation, and the second port comprising a suction port when the pump is disposed in a clockwise orientation and a discharge port when the pump is disposed in a counter-clockwise orientation;

a selectably removable second gear casing disposed distally and adjacent to the separator plate, the second gear casing comprising a second gear chamber housing a second driver gear operably, fixedly engaged with the driver shaft, and a second driven gear meshedly engaged with the second driver gear and engaged with a second driven shaft; and a casing head disposed at the distal end of the pump, the casing head selectably, fixedly engaged with the gear casing and bracket, the casing head comprising a driver shaft end cavity to operably hold the driver shaft, the driver shaft end cavity closed at the distal end inside the casing head.

15. The pump of claim 14, comprising a selectably removable second separator plate and a selectably removable third gear casing, the second separator plate operably disposed between the second gear casing and the third gear casing, wherein the third gear casing comprises a third gear chamber housing a third driver gear operably, fixedly engaged with the driver shaft, and a third driven gear meshedly engaged with the third driver gear and engaged with a third driven shaft.

16. The pump of claim 15, the second separator plate comprising a third pumping chamber fluidly coupled with the first pumping chamber, and a fourth pumping chamber fluidly coupled with the second pumping chamber.

17. The pump of claim 14, the first gear casing operably interchangeable with the second gear casing.

* * * * *